US010729227B2

(12) United States Patent
Grossman et al.

(10) Patent No.: US 10,729,227 B2
(45) **Date of Patent: *Aug. 4, 2020**

(54) SIGNAL CABLE COUPLER

(71) Applicants: Emma Van Fox Grossman, Vienna, VA (US); David G. Grossman, Vienna, VA (US)

(72) Inventors: Emma Van Fox Grossman, Vienna, VA (US); David G. Grossman, Vienna, VA (US)

( * ) Notice: Subject to any disclaimer, the term of this patent is extended or adjusted under 35 U.S.C. 154(b) by 25 days.

This patent is subject to a terminal disclaimer.

(21) Appl. No.: 15/911,132

(22) Filed: Mar. 4, 2018

(65) Prior Publication Data

US 2018/0184790 A1 Jul. 5, 2018

Related U.S. Application Data

(63) Continuation of application No. 14/979,600, filed on Dec. 28, 2015, now Pat. No. 9,936,793.

(60) Provisional application No. 62/097,085, filed on Dec. 28, 2014.

(51) Int. Cl.
*A45F 5/00* (2006.01)

(52) U.S. Cl.
CPC ..... *A45F 5/00* (2013.01); *A45F 2005/002* (2013.01); *A45F 2005/006* (2013.01)

(58) Field of Classification Search
CPC . A45F 5/00; A45F 2005/002; A45F 2005/006
USPC ..... 224/576
See application file for complete search history.

(56) References Cited

U.S. PATENT DOCUMENTS

| | | | | |
|---|---|---|---|---|
| 4,993,065 | A | 2/1991 | Chiou | |
| 6,707,924 | B1 | 3/2004 | Okiebisu | |
| 6,898,295 | B2 * | 5/2005 | Inamura | H01B 7/00 381/374 |
| 7,236,751 | B2 | 6/2007 | Ono | |
| 7,643,646 | B2 | 1/2010 | Fielding, Jr. | |
| D660,822 | S | 5/2012 | Holst | |
| D684,542 | S * | 6/2013 | Ledesma | D13/153 |
| 8,652,062 | B1 | 2/2014 | Holder | |
| 2002/0090099 | A1 | 7/2002 | Hwang | |
| 2002/0173346 | A1 | 11/2002 | Wang | |
| 2007/0053523 | A1 | 3/2007 | Iuliis | |
| 2008/0188124 | A1 | 8/2008 | Kim | |
| 2008/0283651 | A1 | 11/2008 | Ito | |
| 2015/0062790 | A1 | 3/2015 | Eldershaw | |

* cited by examiner

*Primary Examiner* — Peter N Helvey
(74) *Attorney, Agent, or Firm* — David Grossman

(57) ABSTRACT

An apparatus comprises a signal cable and a coupler. The signal cable comprises: a first signal connector at a first end of the signal cable, and a second signal connector at a second end of the signal cable. The coupler is configured to be supported by the signal cable. The coupler comprises: a first fastener configured to constrain the first signal connector, a second fastener configured to constrain the second signal connector, and a third fastener configured to hold an article.

23 Claims, 24 Drawing Sheets

SIGNAL CABLE COUPLER

CROSS-REFERENCE TO RELATED APPLICATIONS

This application is a continuation of U.S. patent application Ser. No. 14/979,600, filed Dec. 28, 2015, which claims the benefit of U.S. Provisional Application No. 62/097,085, filed Dec. 28, 2014, which are hereby incorporated by reference in its entirety.

BACKGROUND OF THE INVENTION

There is a need for helping people keep track of cables such as charging and data cables.

BRIEF DESCRIPTION OF THE SEVERAL VIEWS OF THE DRAWINGS

Example

Example

Example

Example

Example

Example

Example

Example

Example

Example

Example

Example

Example

Example

Example

Example

Example

Example

Example

Example

Example

Example

Example FIG. 23A, FIG. 23B and FIG. 22C are diagrams of a lanyard with rear embedded catches and an imprintable area surrounding a sleeve as per an aspect of an embodiment of the present invention.

Example

DETAILED DESCRIPTION OF EMBODIMENTS

Figure 1:
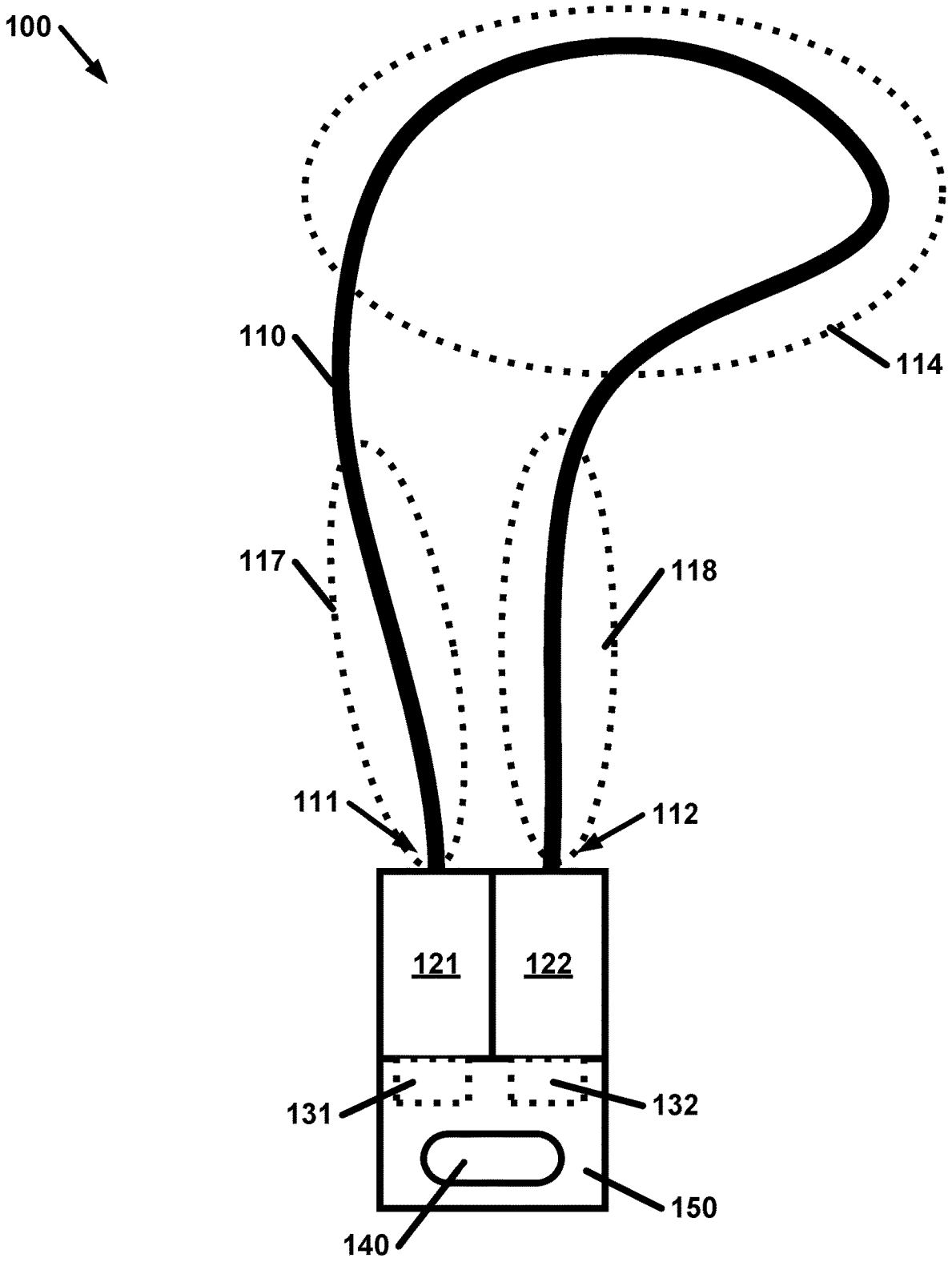
FIG. 1 is a diagram of a lanyard as per an aspect of an embodiment of the present invention.

Embodiments of the present invention comprise a lanyard configured to use a detachable signal data cable cord. Example FIG. 1 is a diagram of a lanyard 100 as per an aspect of an embodiment of the present invention. This example embodiment 100 comprises a signal cable 110, a first signal connector 121, a second signal connector 122, a first catch 131, a second catch 132, and an attachment mechanism 140. In this disclosure, a catch and/or attachment mechanism may comprise a fastener. A fastener may be configured to constrain and/or hold an object such as, but not limited to a signal cable and/or a physical article.

The signal cable 110 may comprise a first end 111 and a second end 112, a center portion 114, a first portion 117 and a second portion 118. The first portion 117 may comprise the section of the signal cable 110 between the center portion 114 and the first end 111. The second portion 118 may comprise the section of the signal cable 110 between the center portion 114 and the second end 112. According to some of the various embodiments, the first end 111 may comprise the first signal connector 121 and/or the second end 112 may comprise the second signal connector 122.

The signal cable 110 may comprise at least one of the following: a charging cable, a data cable, a serial communications cable, a telecommunications cable, a fiber optic cable, a network cable, a flat cable, an electrical cable, a balanced pair cable, a split pair cable, a shielded cable, a coaxial cable, an optical cable, combinations thereof, and/or the like.

The signal cable 110 may be sized to comfortably hold objects around a user's neck. To do so, the signal cable 110 may be, for example between 12 inches and 48 inches long. However, it is anticipated that alternative embodiments may comprise signal cable 110 sized at different lengths to achieve various other functional and/or stylistic purposes. For example, signal cable 110 may be sized so that objects connected to the lanyard may be placed in a pocket, such as, for example, a back pocket, and/or a shirt pocket.

Signal cable 110 may comprise a multi-conductor cable configured to support the transfer of data via a communications protocol. A communications protocol comprises a mechanism to transmit data from one point to another. A communications protocol may comprise a system of rules for data exchange within or between devices such as, but not limited to: electronic devices, optical devices, combinations thereof, and/or the like. A protocol may be implemented as a combination of hardware and/or software/firmware. Example protocols may be configured to be compatible with standard and/or proprietary interfaces such as, but are not limited to: USB (Universal Serial Bus) standards (e.g. USB 1.0, USB 2.0, USB 3.0), LIGHTNING™ computer bus, RS-232, RS-422, ETHERNET™, FIREWIRE™, HDMI™ (High-Definition Multimedia Interface), combinations thereof, and/or the like. USB stands for Universal Serial Bus and is an industry standard that defines the cables, connectors and communication protocols used in a bus for connection, communication, and power supply between computers and electronic devices. HDMI™ is a proprietary audio/video interface for transferring uncompressed video data and compressed or uncompressed digital audio data from an HDMI-compliant source device, such as a display controller, to a compatible computer monitor, video projector, digital television, or digital audio device. RS-232 and RS-422 are standards for serial communication transmission of data. Ethernet comprises a family of computer networking technologies generally employed for local area (LAN) and larger networks.

According to some of the various embodiments, signal cable 110 may be configured to carry a digital signal, an analog signal, a combination thereof, and/or the like. The digital signal may be directional and/or non-directional. Signal cable 110 may be configured to transport a direct current and/or AC signal employable for charging a device. Signal cable 110 may be configured to transport an analog audio signal.

Signal cable 110 may be configured to support power charging of a device, such as for example, a tablet, a cell phone, a headset, a camera, recording equipment, a combination thereof, and/or the like. The cable may be configured to handle DC and/or AC power over an electrical cable. In yet other embodiments, the signal cable may comprise an optical cable. In such a case, data and/or power may be transmitted to a device via the cable in the form of photons.

The first signal connector 121 may be located at a first end 111 of signal cable 110. Similarly, the second signal connector 122 may be located at a second end 112 of signal cable 110. First signal connector 121 and/or second signal connector 122 may be referred to herein as the signal connectors. The signal connectors (121 and/or 122) may be configured to communicate signals from the signal cable 110 to external devices. To do this, signal connectors (121 and/or 122) may be configured with connectors that are compatible with various devices, such as, for example, but not limited to: portable devices, cell phones, tablets, music players, video players, radios, computing devices, test equipment, computer peripherals, consoles, combinations thereof, and/or the like. So, for example, signal connectors (121 and/or 122) could comprise one of the following connectors: a USB connector, a LIGHTNING™ connector, an HDMI™ connector, a DIN connector, an Ethernet connector, combinations thereof, and/or the like. A DIN connector is an electrical connector that was originally standardized by the Deutsches Institut für Normung (DIN), the German national standards organization.

According to some of the various embodiments, the signal connectors (121 and/or 122) may be configured to be wider than the width of catches (131 and and/or 132) with sufficient strength to support the weight of the attachment mechanism 140 while employed to hold typical objects that a user may wish to hold on the end of lanyard 100. Signal connectors (121 and/or 122) may comprise combinations of metal, plastics, wood, and/or other suitable materials in configurations to support their signal connector purpose. Additionally, the signal connectors (121 and/or 122) may be configured to enhance attachment roles. For example, the signal connectors (121 and/or 122) may be configured to connect to each other, connect to the attachment mechanism, combinations thereof, and/or the like, some examples of which are represented in the additional figures and descriptions.

A first catch 131 may be configured to constrain the first portion 117 of the signal cable 110. The first catch 131 may be a structure that allows the signal cable 110 to be removed with a release motion. Similarly, the first catch 131 may be configured to constrain the first portion 118 of the signal cable 110. The first catch 131 may be a structure that allows the signal cable 110 to be removed with a release motion. According to some of the various embodiments, the first catch 131 may constrain the signal connectors (121 and/or 122). In such an example embodiment, the first catch 131 may be configured or formed with a receptacle structure.

A second catch 132 may be configured to constrain the second portion 118 of the signal cable 110. The second catch 132 may be a structure that allows the second portion 118 to be removed with a release motion. Similarly, the second catch 132 may be configured to constrain the second portion 118 of the signal cable 110. The catch portion may be a structure that allows the signal cable 110 to be removed with a release motion. According to some of the various embodiments, the second catch 132 may constrain the signal connectors (121 and/or 122). In such an example embodiment, the second catch 132 may be configured or formed with a receptacle structure.

According to some of the various embodiments, the first catch 131 and the second catch 132 are integrated. In other words, the first catch 131 and the second catch 132 may be a singular structure, examples of which are shown in some of the various figures and accompanying descriptions.

According to some of the various embodiments, the first catch 131 may be connected and/or integrated with the first signal connector 121. Similarly, according to some of the various embodiments, the second catch 132 may be connected and/or integrated with the second signal connector 122.

According to some of the various embodiments, an attachment mechanism 140 may be adapted for mounting a separate object to be displayed or used by a wearer of a lanyard 100. The attachment mechanism may be configured in any one of numerous techniques including, but not limited to: comprises a hole, a slot, a molder catch, a buckle, a clip, a ring, a fastener, combinations thereof, and/or the like. According to some of the various embodiment, the first catch 131 and/or the second catch 132 may comprise the attachment mechanism.

The object may comprise, but not limited to, at least one of the following: a clip, an ID holder, a name tag holder, a name tag, a ring, a strap, a pouch, a swivel Bulldog, a swivel hook, a lobster clip, a bulldog clip, a loop, a carabineer, a buckle, a detachable buckle, a combination thereof, and/or the like. Basically, the object may comprise any object that a user of lanyard 100 may wish hang around their neck. Some objects may be configured to hold additional objects.

According to some of the various embodiments, a coupler 150 may be employed to connect the first catch 131 and the second catch 132. At least the first catch 131 and/or the second catch 132 may, according to some example embodiments, be disposed internally and/or externally to the main body of the coupler 150. A coupler may also be and/or comprise a fastener. According to various embodiments, the coupler 150 may comprise or be integrated with additional items, such as, but not limited to: a battery, a battery charger, a mobile device charger, an attachment mechanism, a name tag, an ID holder, a combination thereof, and/or the like.

Part(s) of lanyard 100 may comprise an imprintable surface. For example, the coupler 150, connector 121, connector 122, combinations thereof, and or the like may comprise the imprintable surface. The imprintable surface may be employed for illustrating an image, such as, but not limited to: a graphic, and identifier, a bar code, a name, a logo, an advertisement, combinations thereof, and/or the like.

Part(s) of lanyard 100 may comprise one or more pockets. Pocket(s) may be configured to hold the signal end of at least the first signal connector 121 and the second signal connector 122. The pocket may be part of the coupler 150.

The lanyard 100 may also comprise a signal cable length adjuster. The signal length adjuster may be configured to shorten or lengthen the effective length of signal cable 110 to fit various size users.

Figure 2:
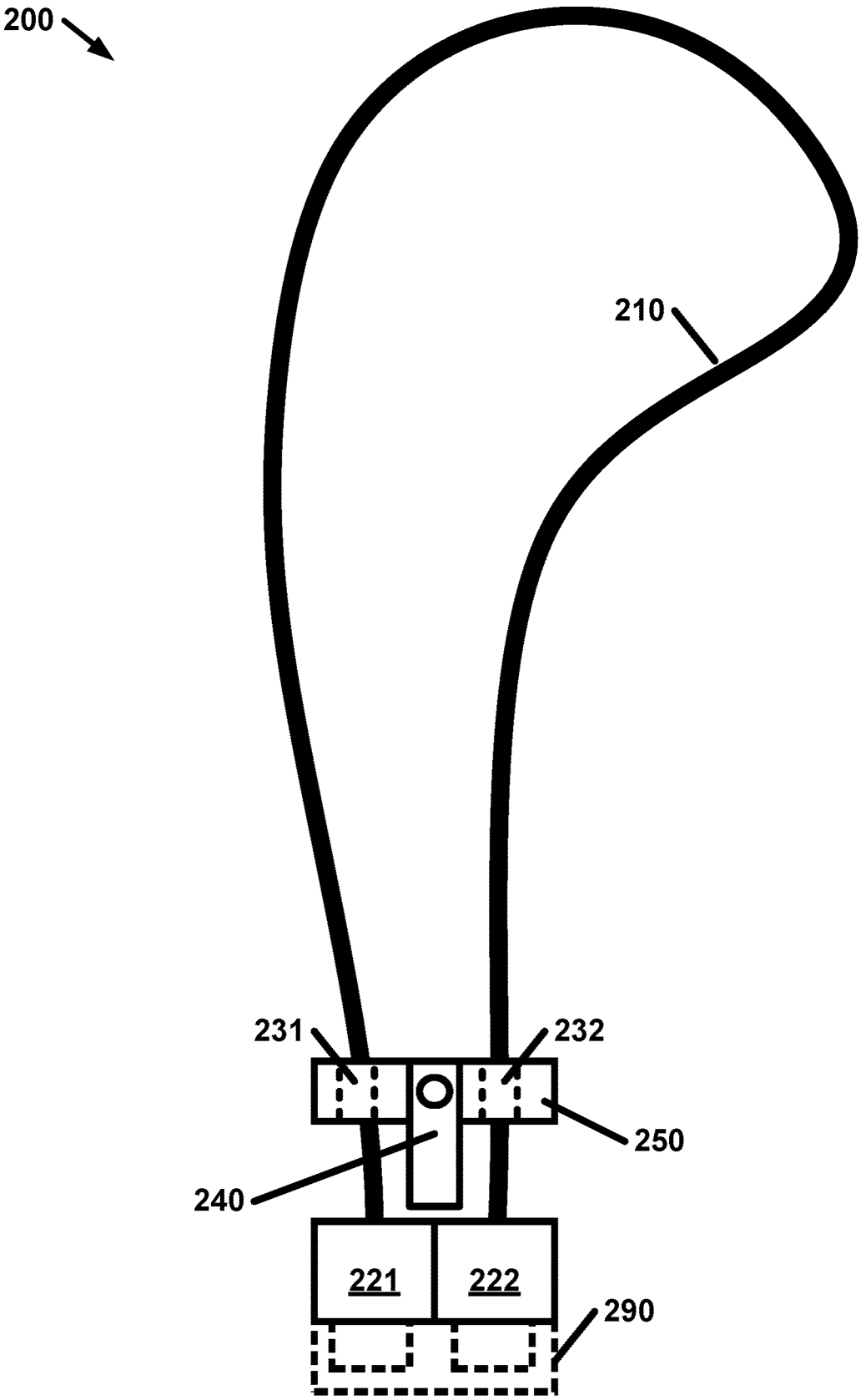
FIG. 2 is a diagram of a lanyard with a coupler and optional cap as per an aspect of an embodiment of the present invention.

FIG. 2 is a diagram of an example lanyard 200 with a coupler 250 and optional cap 290 as per an aspect of an embodiment of the present invention. In this example embodiment, signal cable 210 may be constrained by catches 231 and 232 formed in coupler 250 respectively. An attachment mechanism 240 may be connected to coupler 250. Attachment mechanism 240 may be a loop. Attachment mechanism 240 may be connected to coupler 250, for example, via a rivet. Signal connectors 221 and 222 may be held together by a cap 290.

Figure 3:
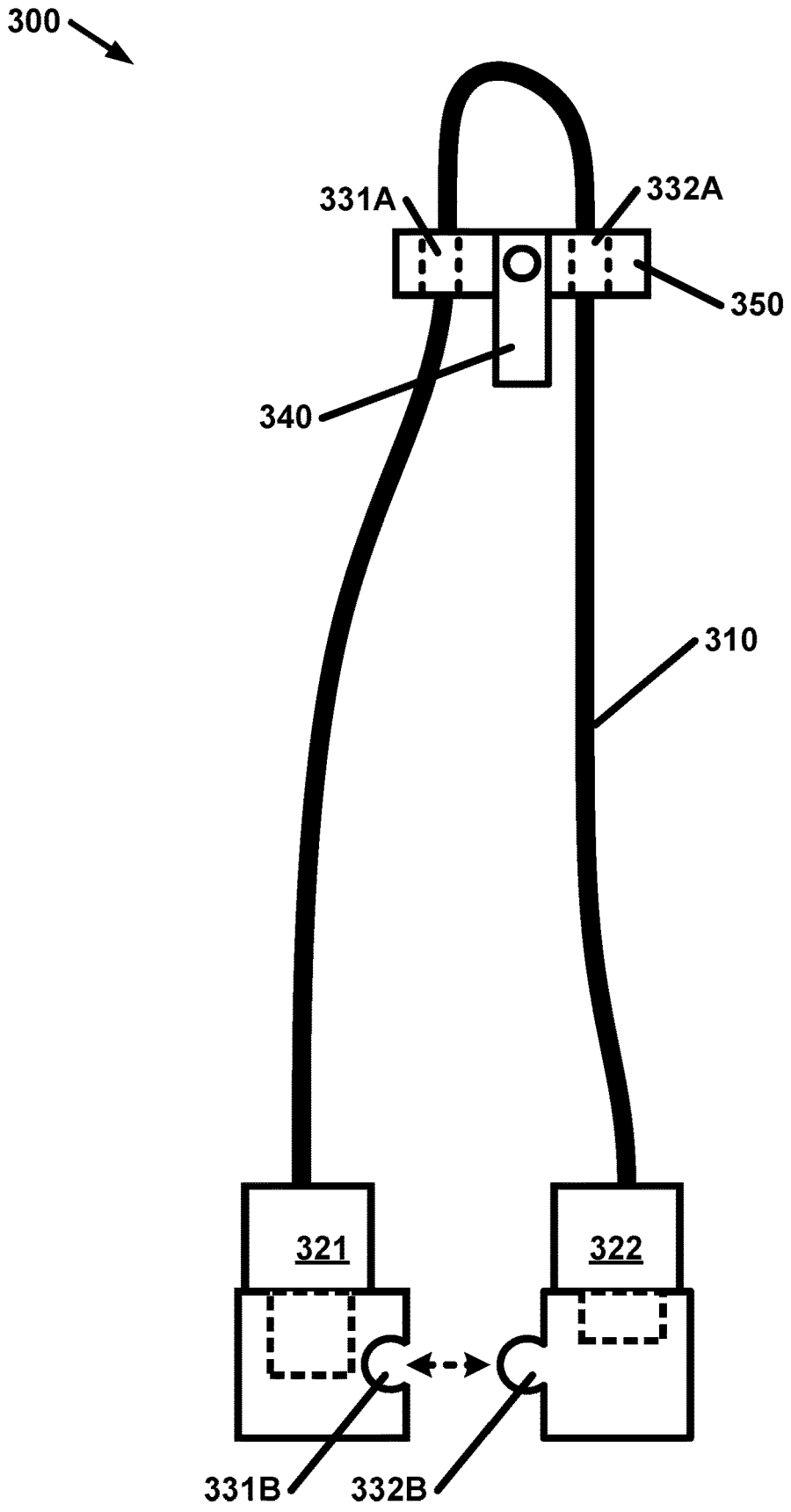
FIG. 3 is a diagram of a lanyard with a coupler and latching connectors as per an aspect of an embodiment of the present invention.

FIG. 3 is a diagram of an example lanyard 300 with a coupler 350 and latching connectors 331 B and 332B as per an aspect of an embodiment of the present invention. This example embodiment illustrates two catch mechanisms employed on the same lanyard 300. Coupler 350 may constrain the signal cable 310 via catches 331A and 332A. Catches 331 B and 332B may constrain signal connectors 321 and 322 respectively. As illustrated in the example embodiment, attachment mechanism 340 is connected to coupler 350.

Figure 4:
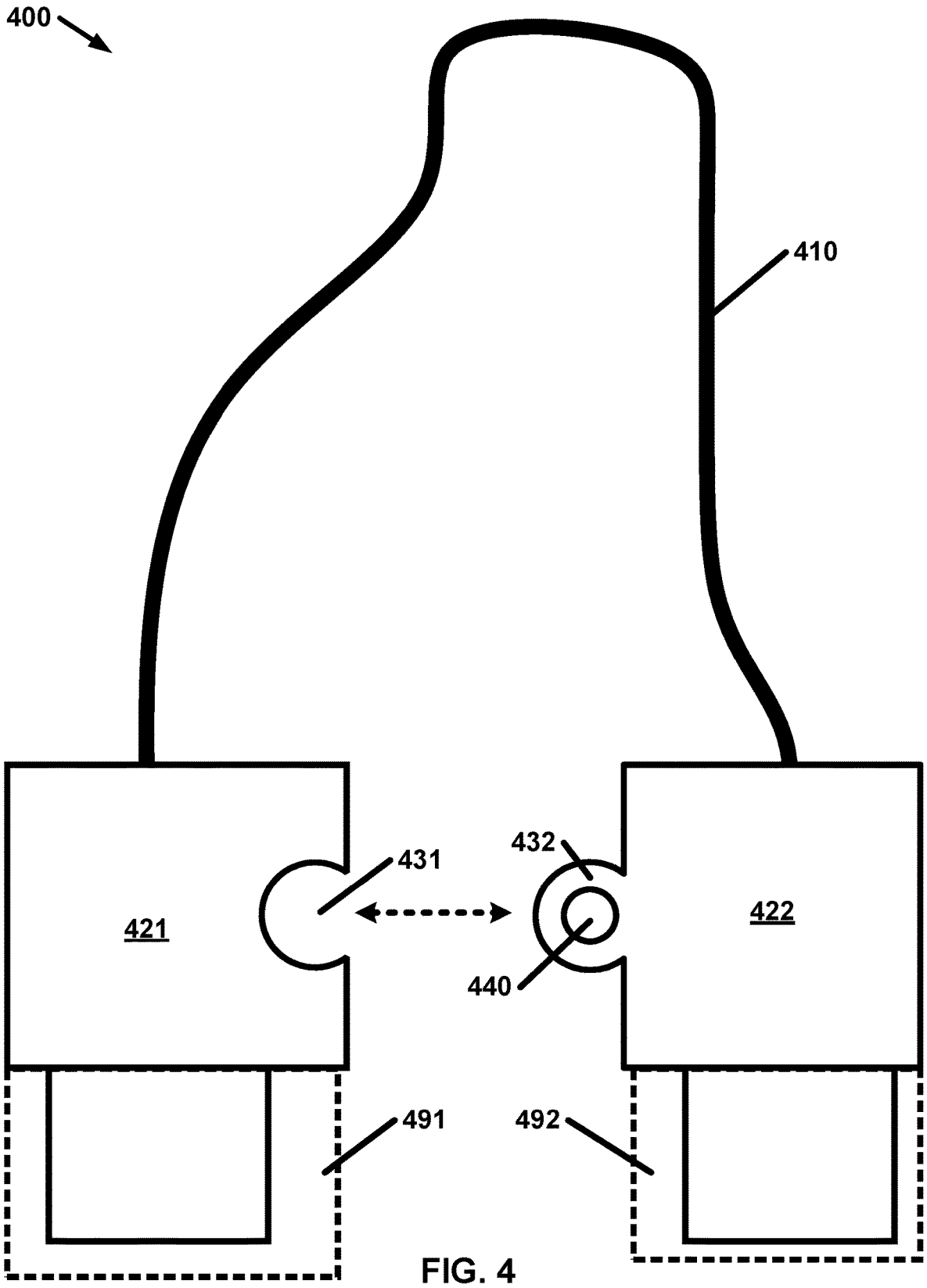
FIG. 4 is a diagram of a lanyard with latching connectors comprising an integrated attachment mechanism as per an aspect of an embodiment of the present invention.

FIG. 4 is a diagram of an example lanyard 400 with latching signal connectors 421 and 422 at the end of signal cable 410 as per an aspect of an embodiment of the present invention. The latching connectors 421 and 422 may comprise integrated attachment mechanisms 431 and 432 respectively. Caps 491 and 492 may be employed in some of the various embodiments to cover at least a portion of the connector section of signal connectors 421 and 422 respectively.

Figure 5:
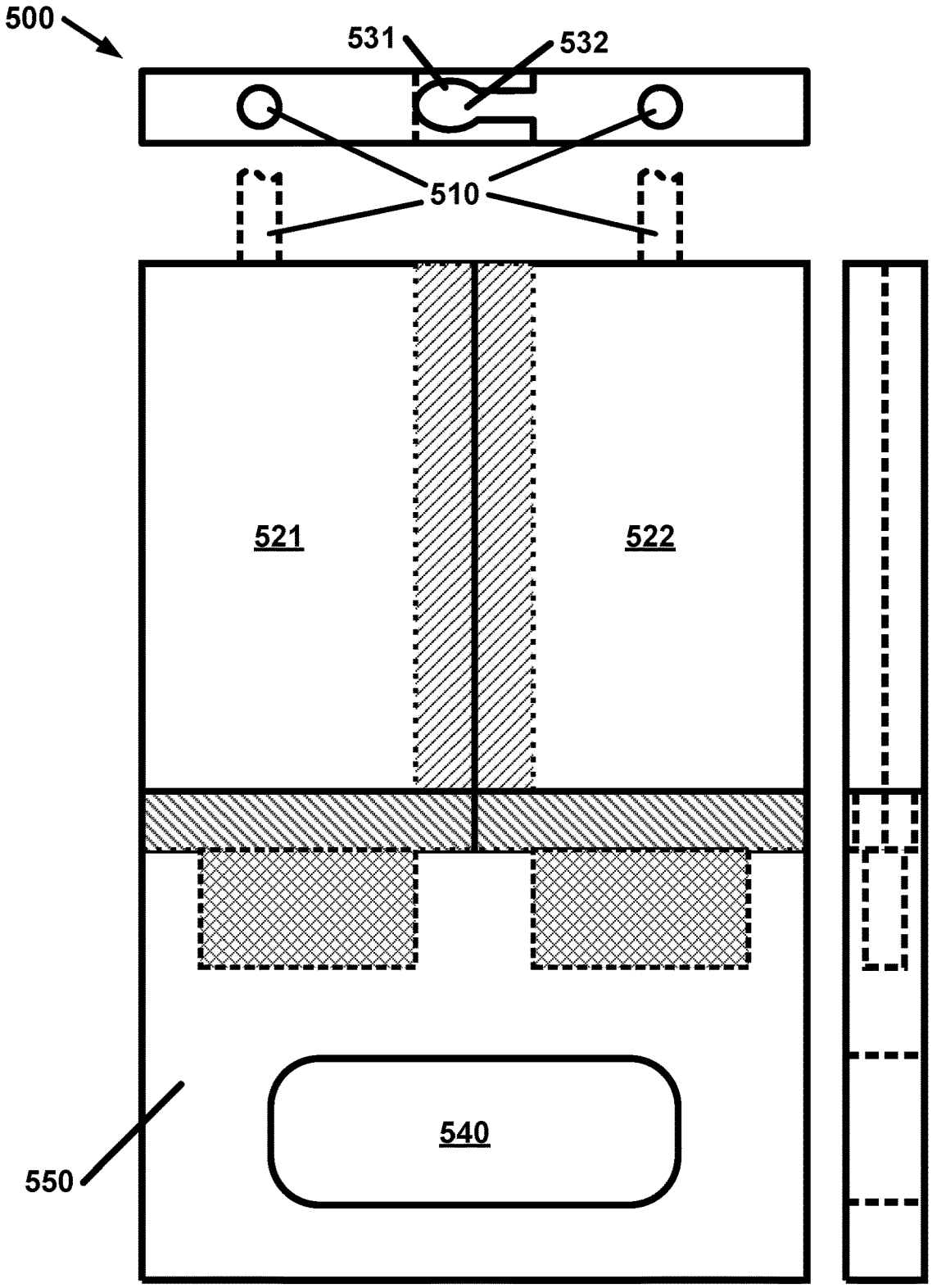
FIG. 5 is a diagram of a lanyard with latching connectors and a slotted attachment mechanism as per an aspect of an embodiment of the present invention.

FIG. 5 is a diagram of an example lanyard 500 with latching signal connectors 521 and 522 and a slotted attachment mechanism 540 as per an aspect of an embodiment of the present invention. This example shows a sliding catch mechanism 531 and 532 that runs along the inner length of signal connectors 521 and 522 respectively. Signal cable 510 is shown in part emanating from the upper end of signal connectors 521 and 522. An example coupler 550, as illustrated, may connect to the lower end of the signal connectors 521 and 523. A slotted attachment mechanism 540 is shown in the coupler. It is envisioned that other configurations of connecting a coupler 550 to the signal connectors 521 and 522 may be employed. Additionally, the slotted attachment mechanism may be adapted to various intended objects.

Figure 6:
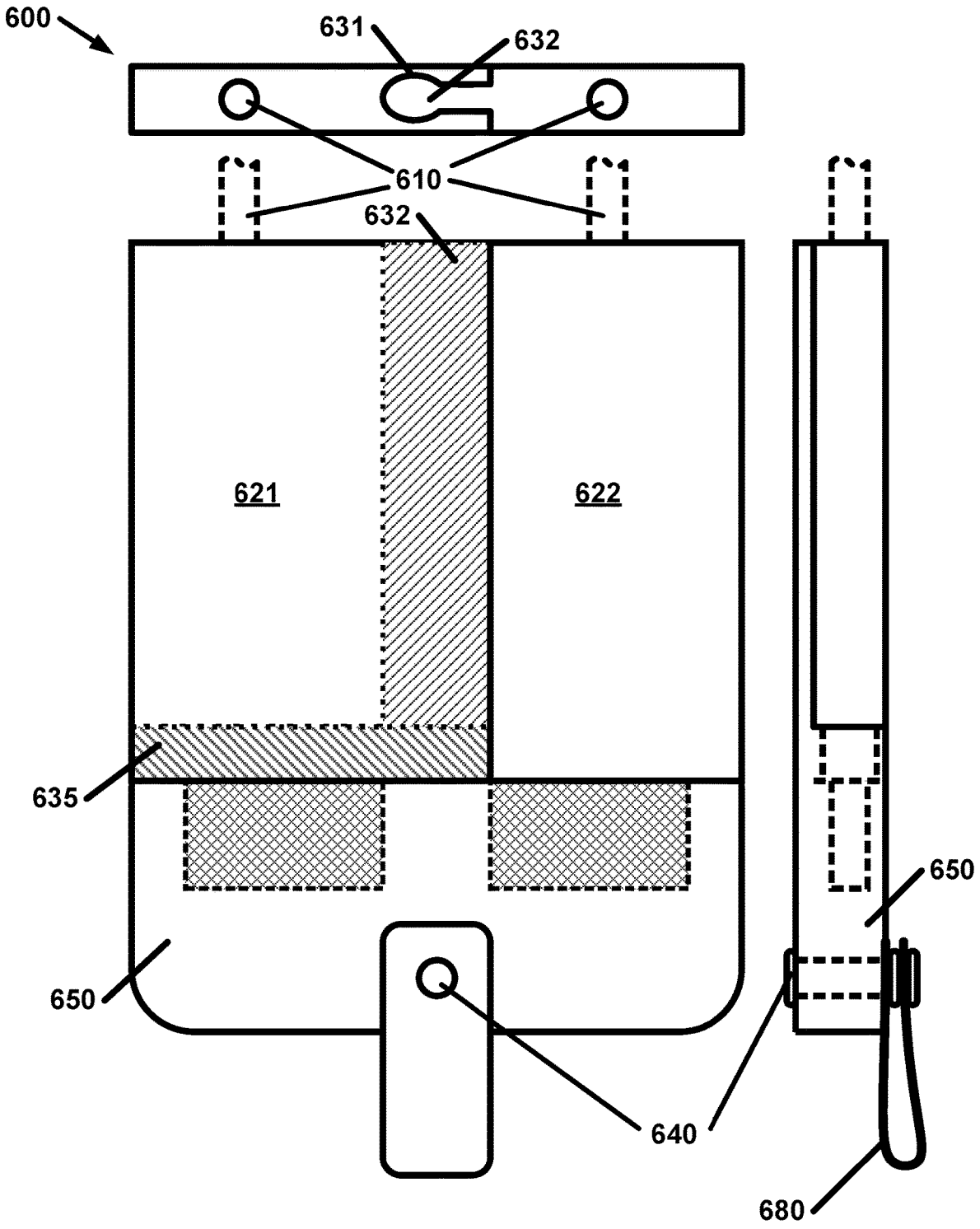
FIG. 6 is a diagram of a lanyard with sliding latching connectors in the connected position as per an aspect of an embodiment of the present invention.
Figure 7:
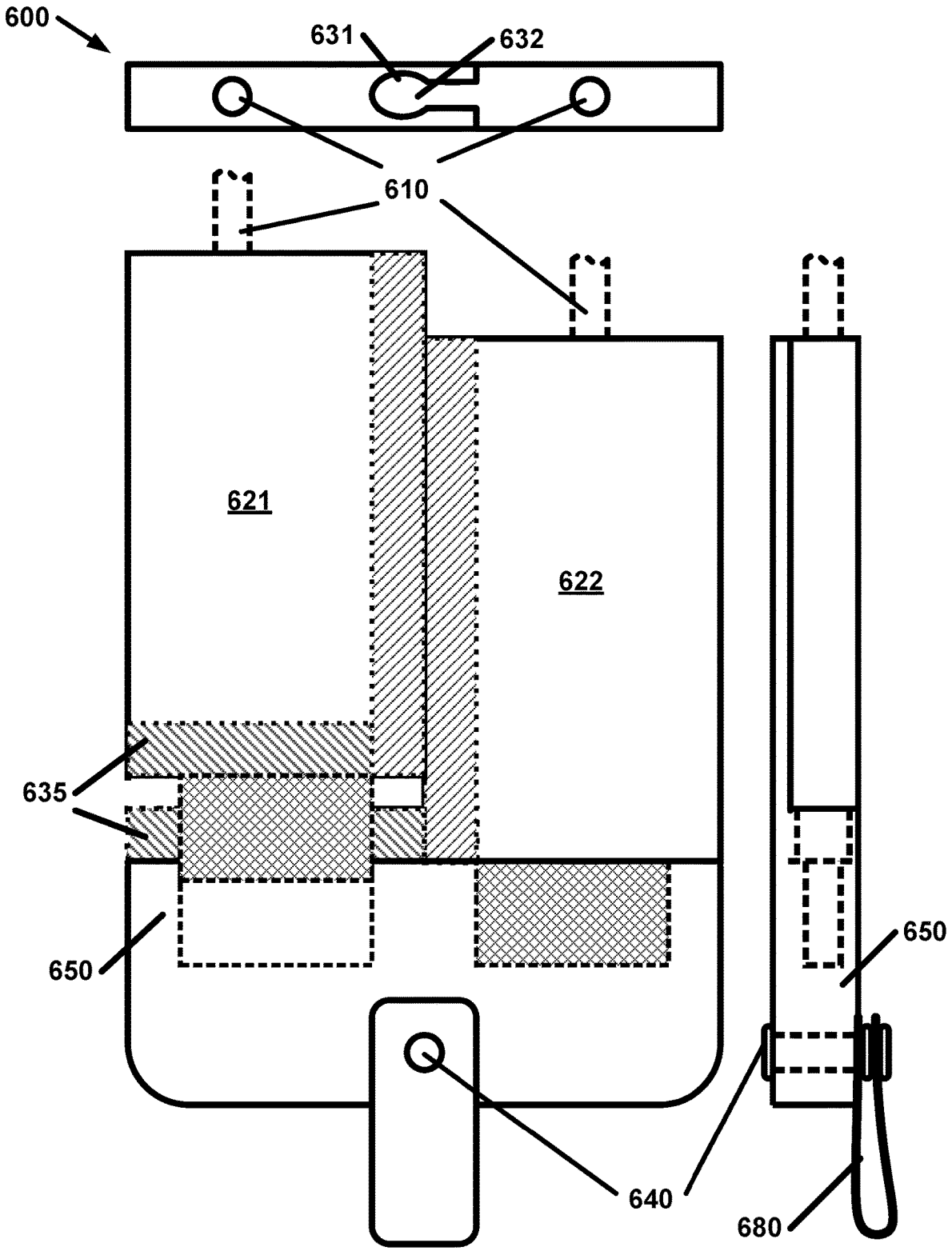
FIG. 7 is a diagram of the lanyard of FIG. 6 in a partially disconnected position as per an aspect of an embodiment of the present invention.

FIG. 6 is a diagram of an example lanyard 600 with sliding latching connectors 621 and 622 in a connected position as per an aspect of an embodiment of the present invention. In this example embodiment, signal cable 610 may be attached to the top segment of signal connectors 621 and 622. A latching mechanism 631 and 632 may act as a sliding mechanism to allow signal connector 621 to release from signal connector 622. According to some of the various embodiments, coupler 650 may be integrally connected to signal connector 622. Signal connector 621 may be connected to coupler 650 via a snapping mechanism 635. According to some of the various embodiments, attachment mechanism 640 may be a rivet and/or snap holding a loop object 680. FIG. 7 is a diagram of an example lanyard 600 of FIG. 6 in a partially disconnected position as per an aspect of an embodiment of the present invention. As illustrated in this example, signal connector 621 is sliding along catch mechanism 631 and 632 after being released from snapping mechanism 635.

Figure 8A:
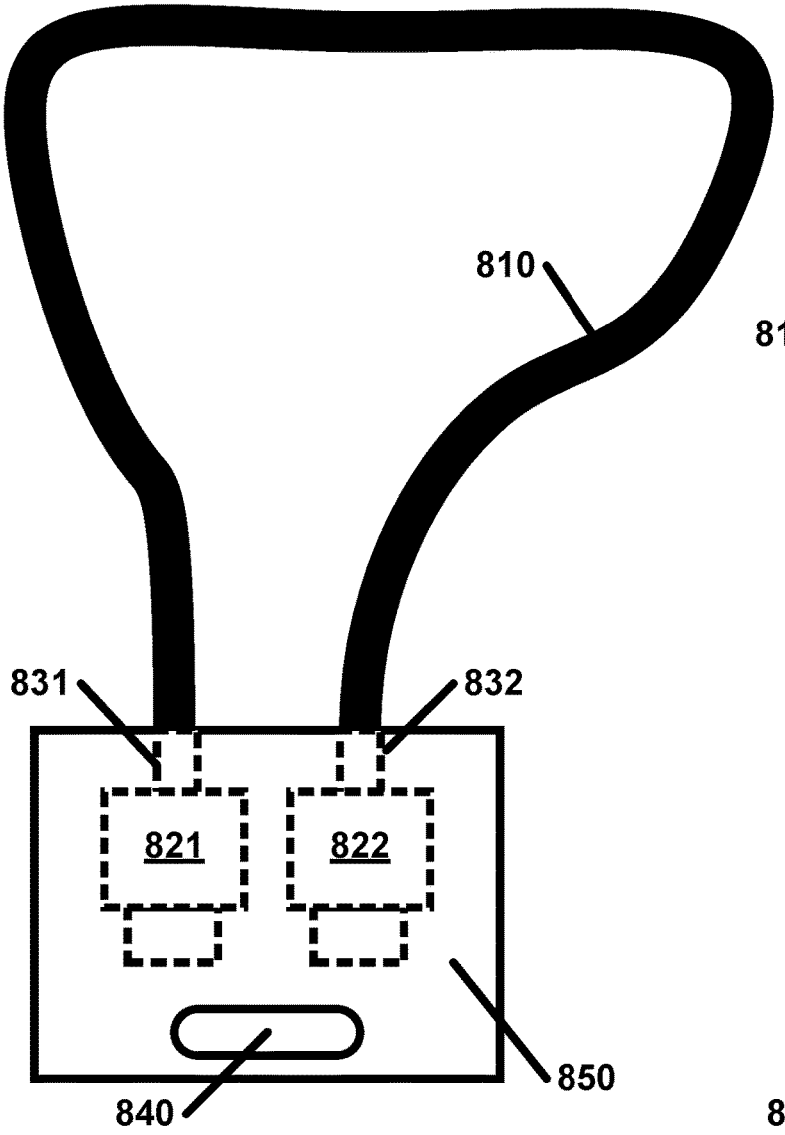
FIG. 8A and FIG. 8B are diagrams of a lanyard with integrated pockets and a slotted attachment mechanism as per an aspect of an embodiment of the present invention.
Figure 8B:
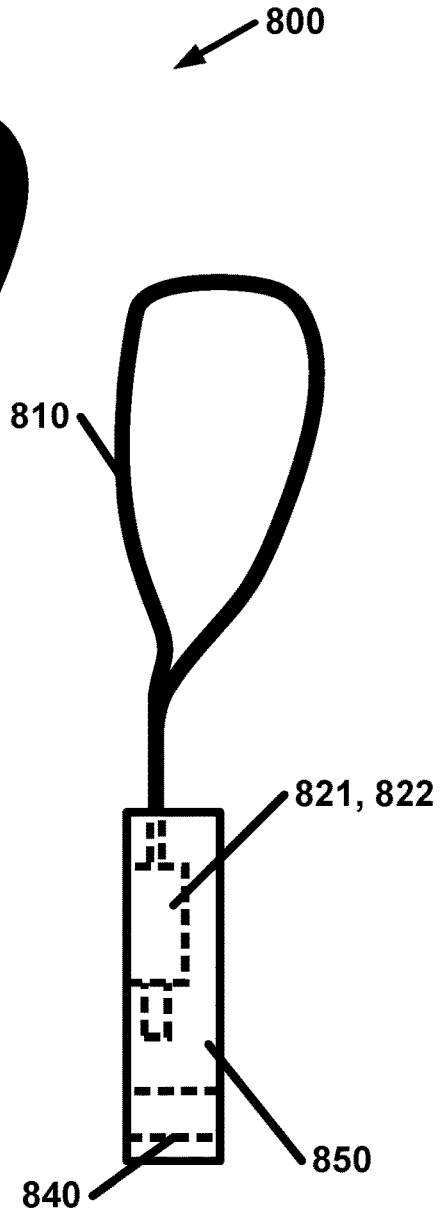

FIG. 8A and FIG. 8B are example diagrams showing a front view (FIG. 8A) and side view (FIG. 8B) of a lanyard 800 with pocket catches 831 and 832 disposed within coupler 850 as per an aspect of an embodiment of the present invention. Pocket catches 831 and 832 may be configured to hold signal connectors 821 and 822 at the ends of signal cable 810 in coupler 850. According to some of the various embodiments and as illustrated in this example, an attachment mechanism such as slotted attachment mechanism 840 may be disposed in coupler 850.

Figure 9A:
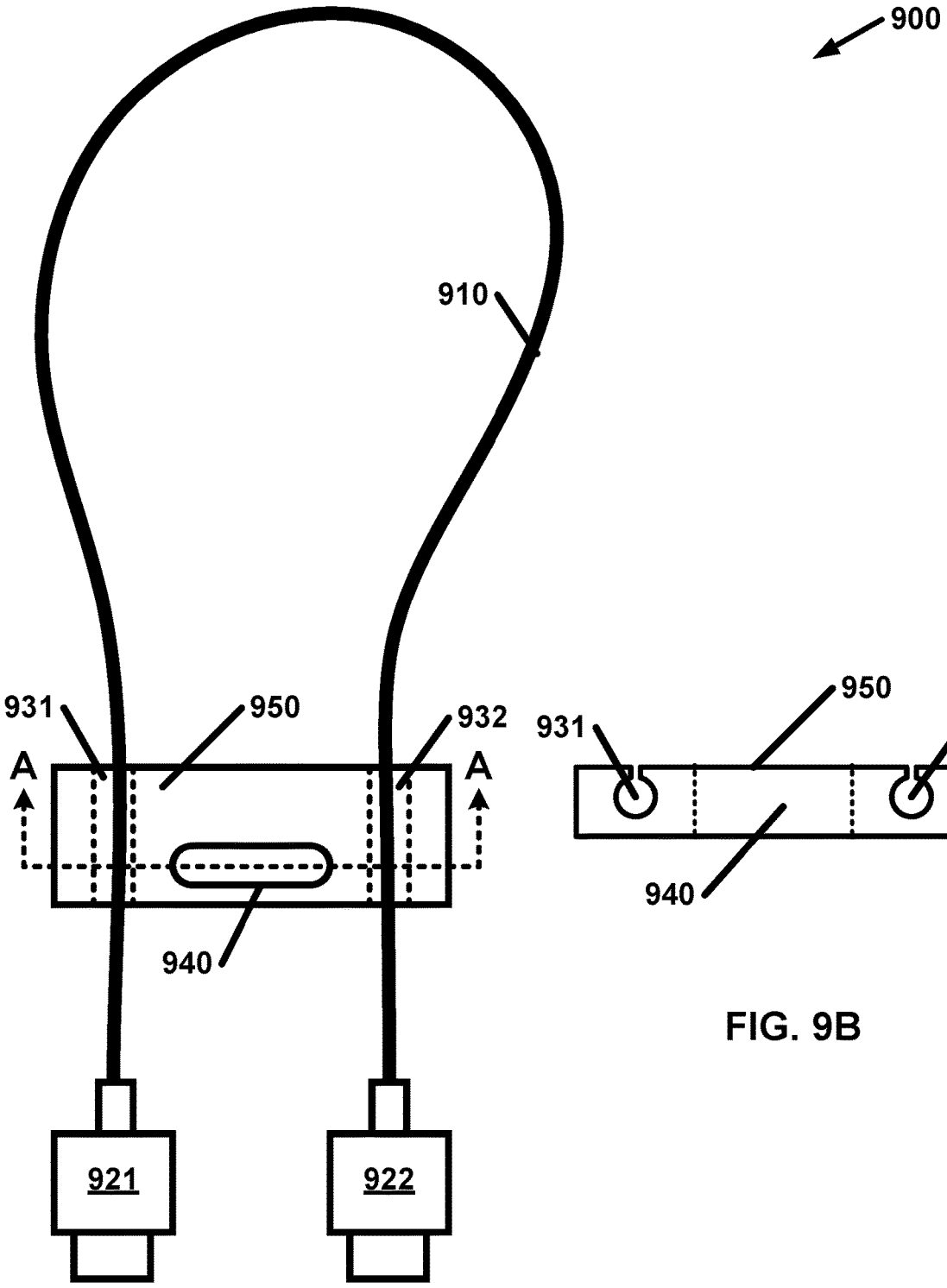
FIG. 9A and FIG. 9B are diagrams of a lanyard with deformable catches and a slotted attachment mechanism as per an aspect of an embodiment of the present invention.
Figure 9B:
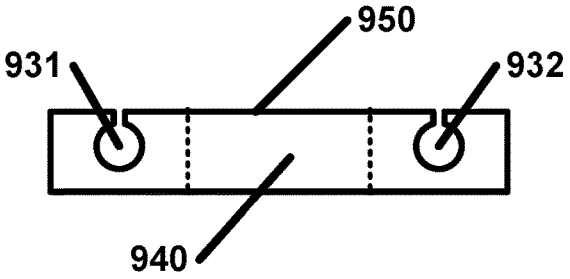

FIG. 9A and FIG. 9B are example diagrams showing a front view (FIG. 9A) and top view along dashed line A-A (FIG. 9B) of a lanyard 900 with deformable catches 931 and 932 disposed within coupler 950 as per an aspect of an embodiment of the present invention. Deformable catches 931 and 932 may be configured to hold portions of signal cable 910. According to some of the various embodiments and as illustrated in this example, an attachment mechanism such as slotted attachment mechanism 940 may be disposed in coupler 950.

Figure 10:
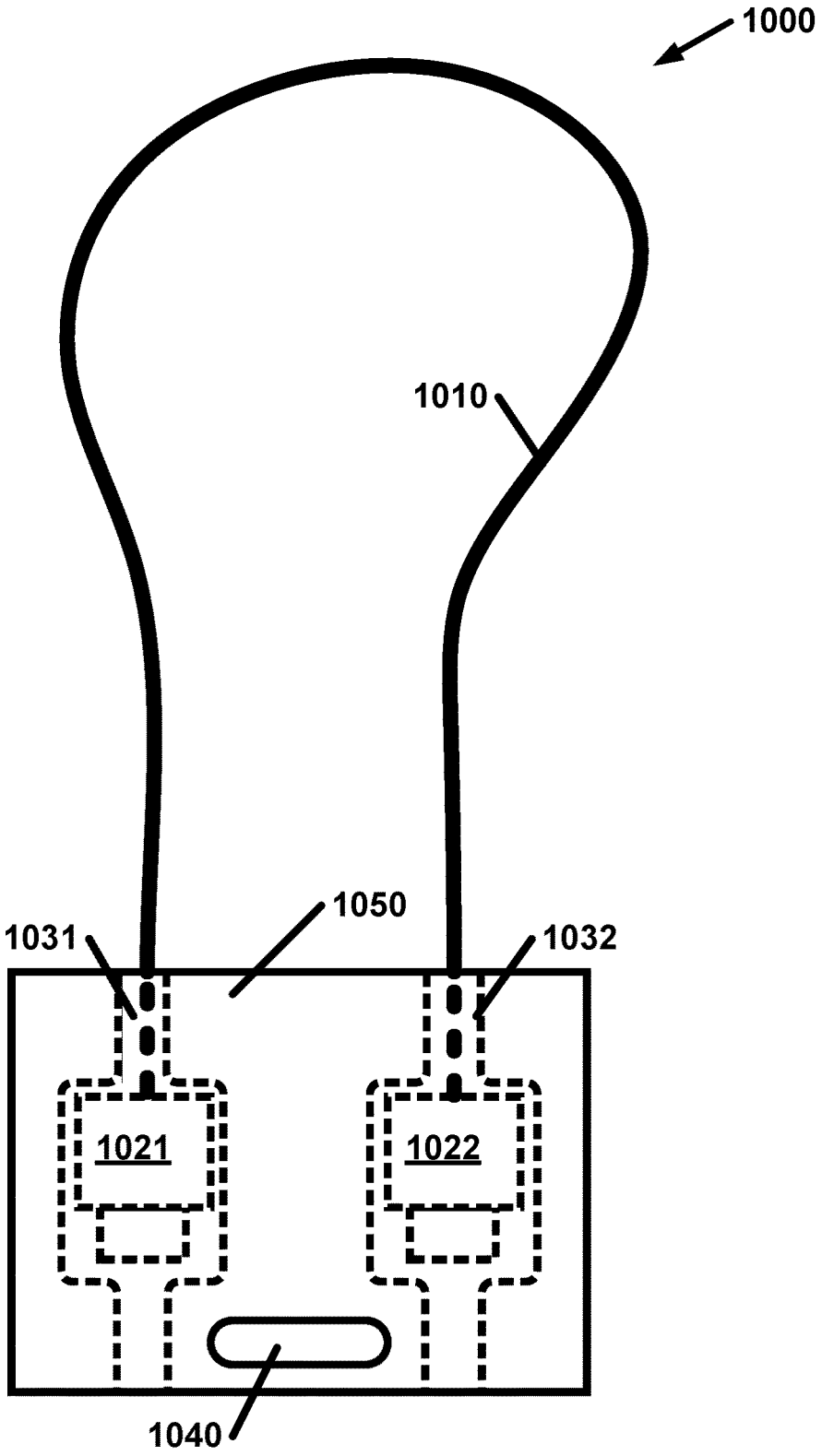
FIG. 10 is a diagram of a lanyard with connector pockets as per an aspect of an embodiment of the present invention.

FIG. 10 is an example diagram of a lanyard 1000 with connector pocket catches 1031 and 1032 disposed within coupler 1050 as per an aspect of an embodiment of the present invention. According to some of the various embodiments and as illustrated in this example, an attachment mechanism such as slotted attachment mechanism 1040 may be disposed in coupler 1050.

Figure 11A:
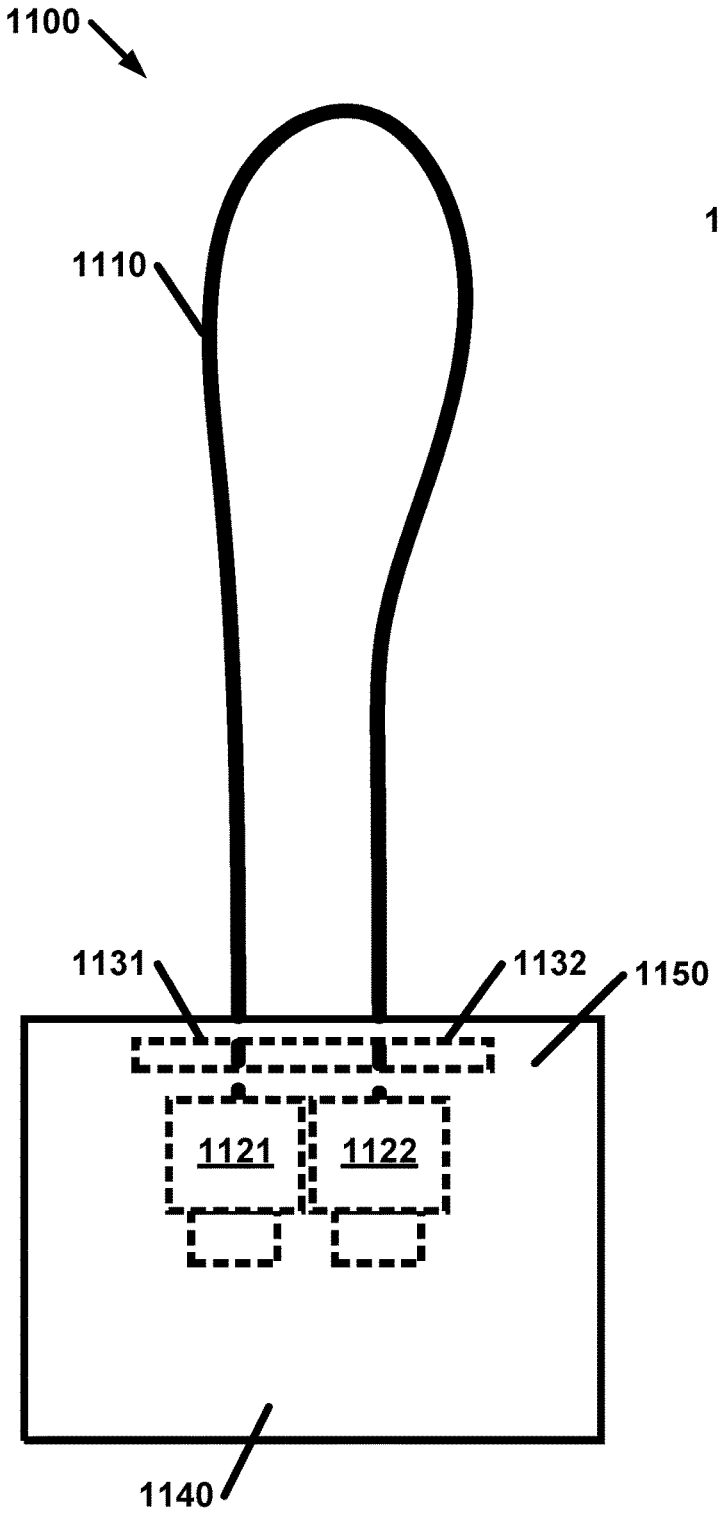
FIG. 11A and FIG. 11B are diagrams of a lanyard with an integrated catch configured to constrain both a first portion and second portion of the signal cable as per an aspect of an embodiment of the present invention.
Figure 11B:
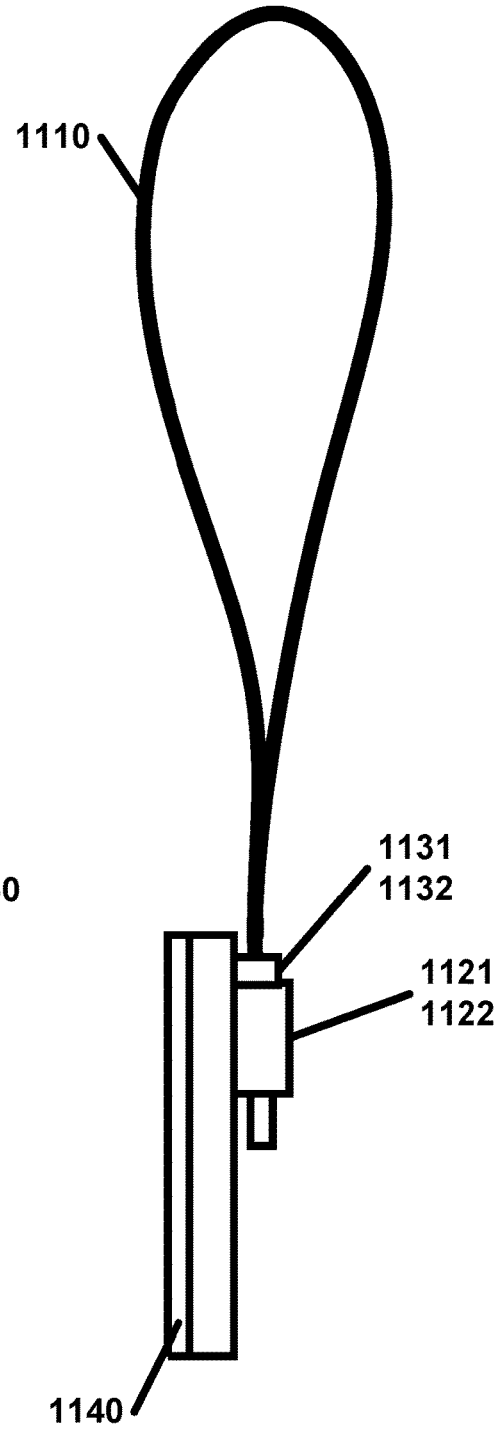

FIG. 11A and FIG. 11B are example diagrams of a lanyard 1100 showing a front view (FIG. 11A) and side view (FIG. 11B) with an integrated catch 1131/1132 disposed on a backside of coupler 1150 as per an aspect of an embodiment of the present invention. Integrated catch 1131/1132 may be configured to constrain both a first portion and second portion of the signal cable 1110. The coupler 1150 may be held by the signal connectors 1121 and 1122 which may be wider than an opening in the integrated catch 1131/1132. According to some of the various embodiments and as illustrated in this example, an attachment mechanism such as sheet 1140 may be disposed on the front side of coupler 1150. Sheet 1140 may form a pocket in which a tag or other type of material and/or object may be inserted. In alternative embodiments, sheet 1140 may be a layer that may comprise an imprintable surface.

Figure 12A:
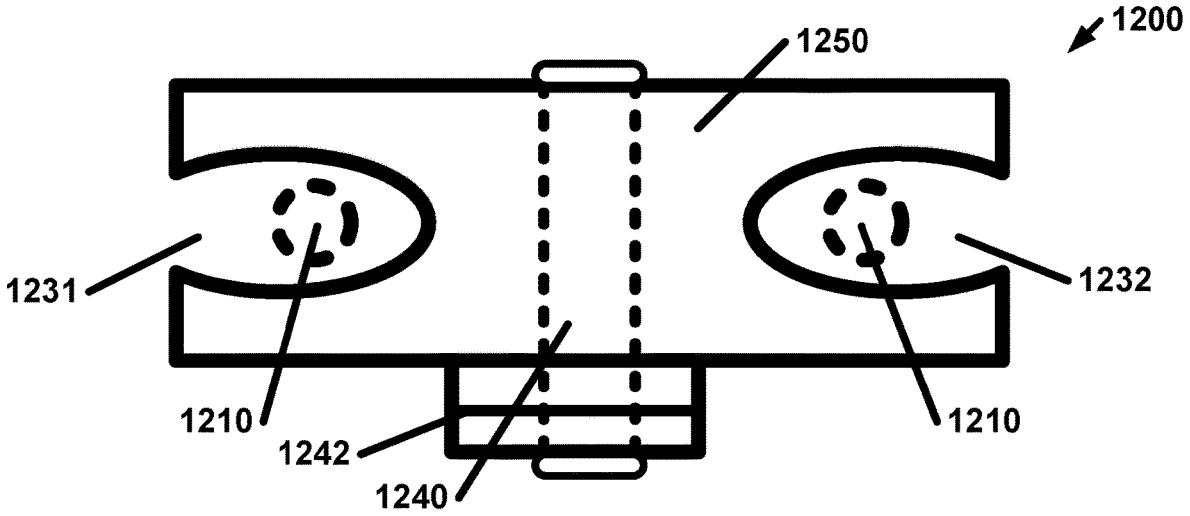
FIG. 12A and FIG. 12B are diagrams of a lanyard with side catches as per an aspect of an embodiment of the present invention.
Figure 12B:
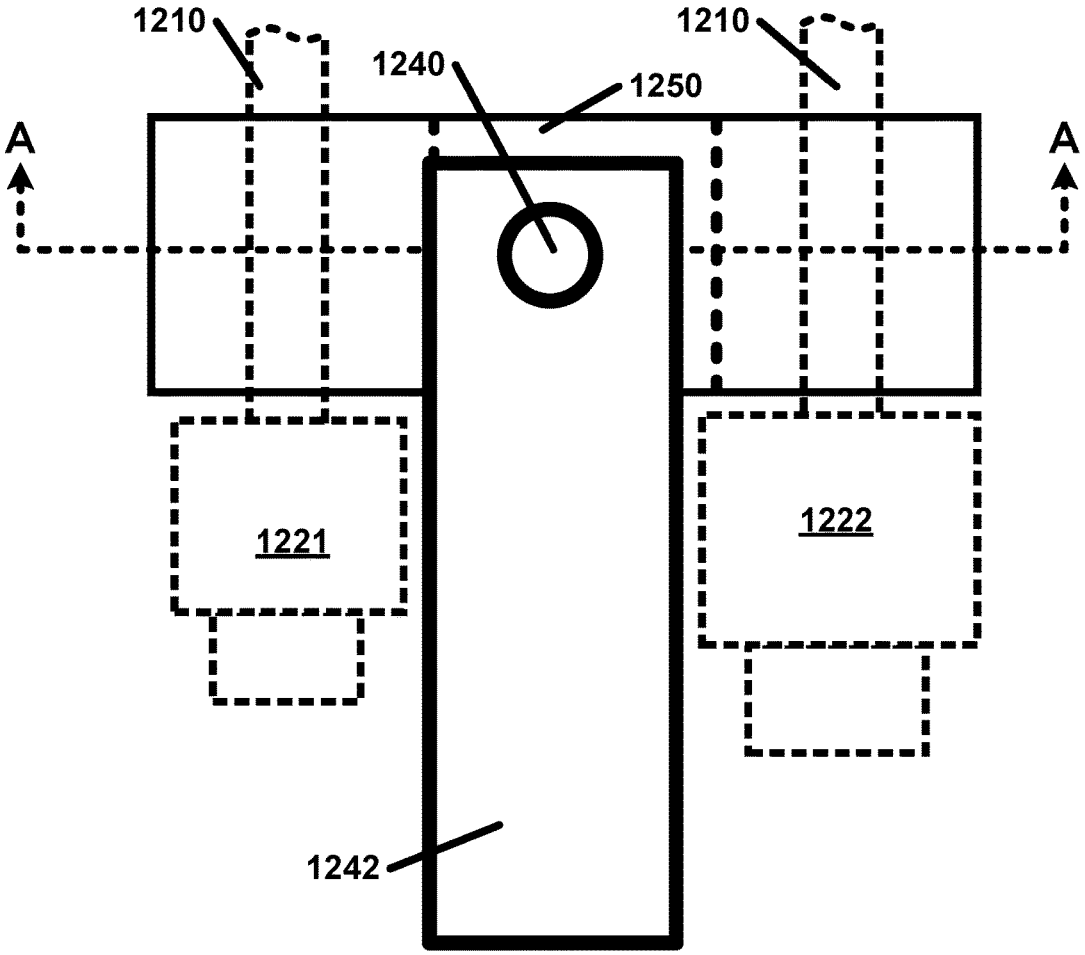

FIG. 12A and FIG. 12B are example diagrams of a lanyard 1200 showing a front view (FIG. 12A) and top view along dashed line A-A (FIG. 12B) with catches 1231 and 1232 disposed with openings along the sides of coupler 1250. Catches 1231 and 1232 may be configured to allow a first portion and a second portion respectively of signal cable 1210 to be constrained. The coupler 1250 may be held by the signal connectors 1221 and 1222 which may be wider than an opening in the catches 1231 and 1232. Attachment mechanism 1240 may be connected to coupler 1250 via, for example, a rivet/snap holding a looping object.

Figure 13A:
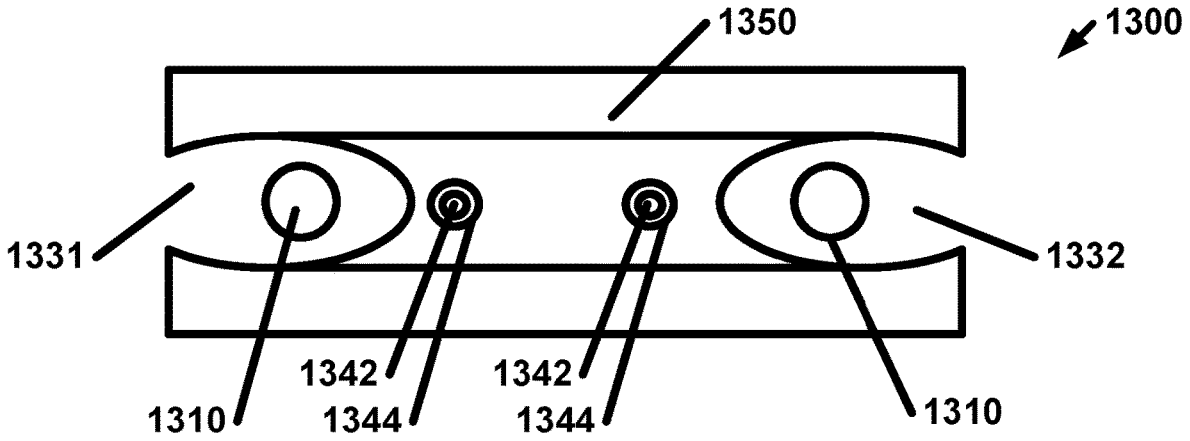
FIG. 13A and FIG. 13B are diagrams of a lanyard with side catches and a loop based attachment mechanism as per an aspect of an embodiment of the present invention.
Figure 13B:
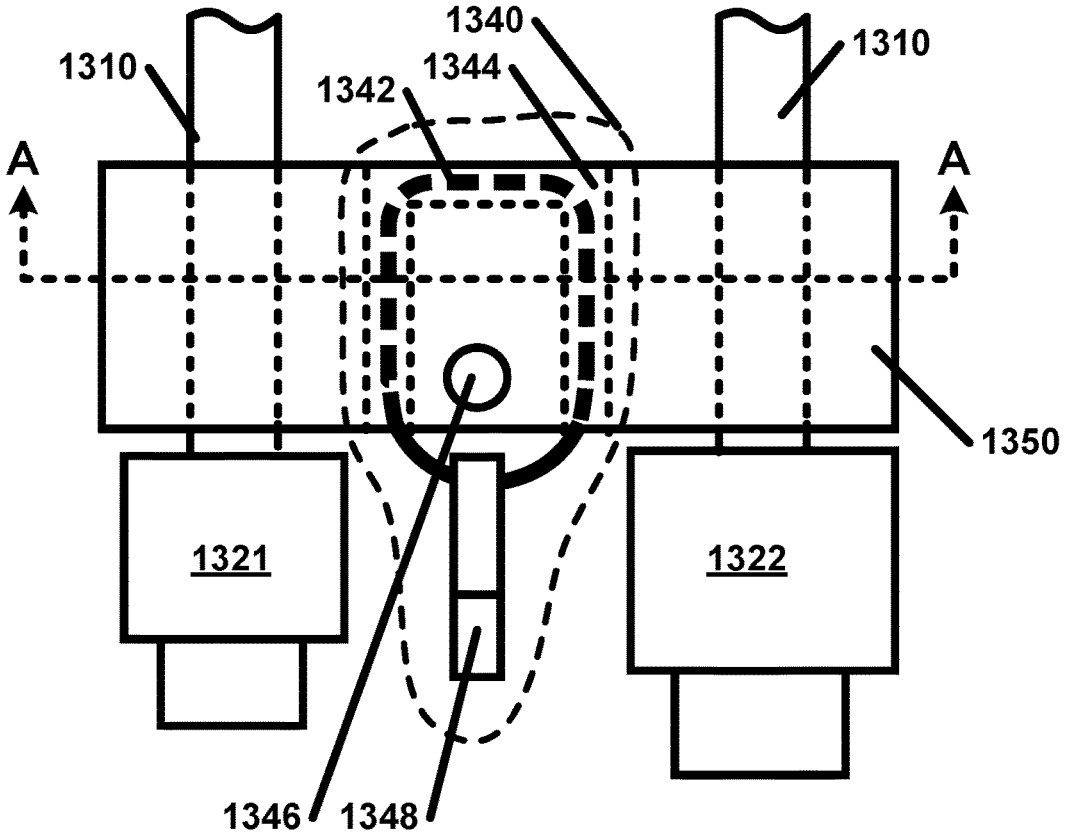

FIG. 13A and FIG. 13B are example diagrams of a lanyard 1300 showing a front view (FIG. 13B) and top view along dashed line A-A (FIG. 13A) with catches 1331 and 1332 disposed with openings along the sides of coupler 1350. Catches 1331 and 1332 may be configured to allow a first portion and a second portion respectively of signal cable 1310 to be constrained. Coupler 1350 may be held by the signal connectors 1321 and 1322 which may be wider than an opening in the catches 1331 and 1332. According to some of the various embodiments, a loop based attachment mechanism 1340 may be connected to coupler 1350 via, for example, loop 1342 through orifice 1344. The loop 1342 may be constructed using many materials including, but not limited to: wire, cloth, plastic, rubber, combinations thereof, and/or the like. A clip 1348 may hang from, be connected to, or be part of loop 1342. An alternative and/or additional attachment mechanism 1346 may comprise a hole that passes through coupler 1350.

Figure 14A:
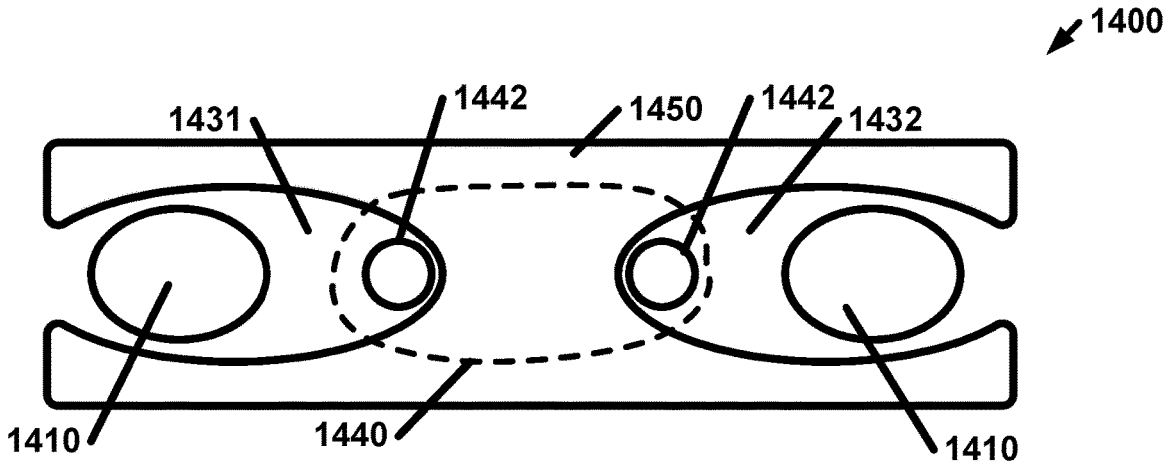
FIG. 14A and FIG. 14B are diagrams of a lanyard with side catches and a loop based attachment mechanism that shares the side catches as per an aspect of an embodiment of the present invention.
Figure 14B:
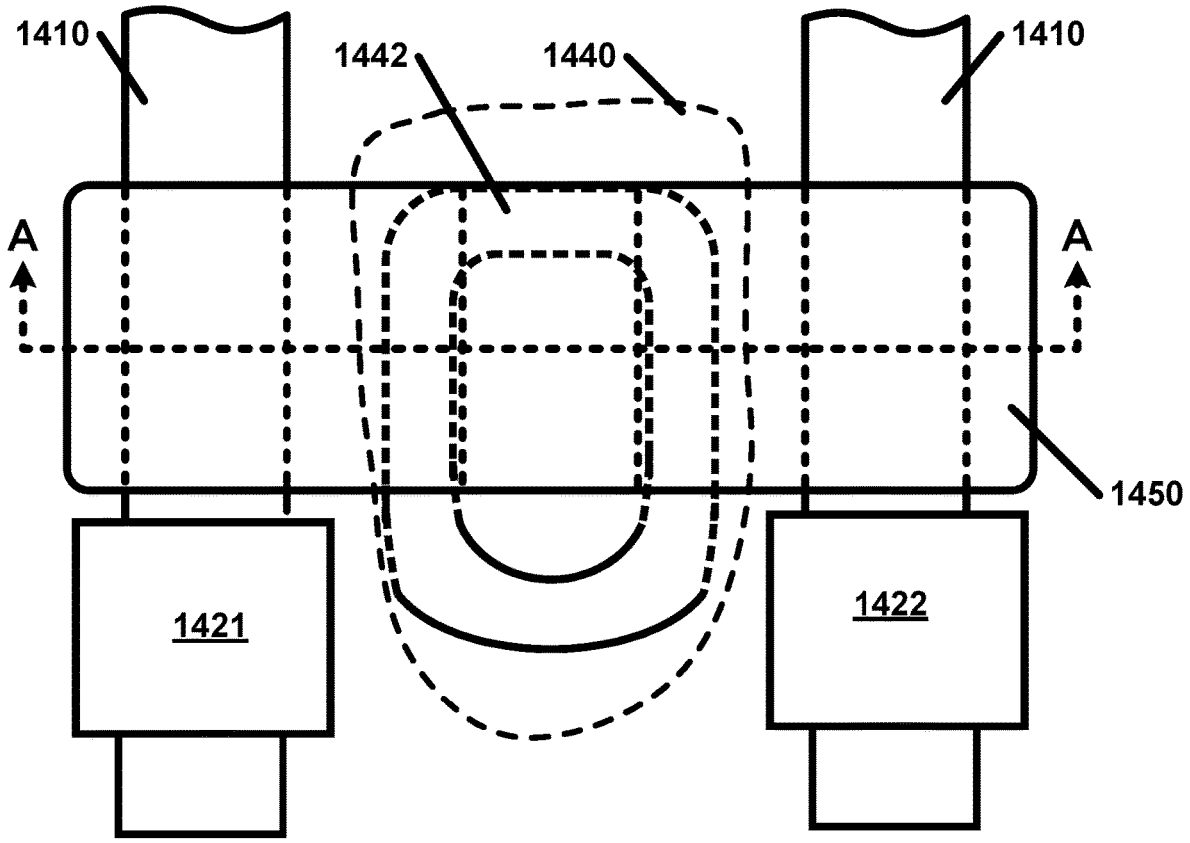

FIG. 14A and FIG. 14B are example diagrams of lanyard 1400 showing a front view (FIG. 14B) and top view along dashed line A-A (FIG. 14A) with catches 1431 and 1432 disposed with openings along the sides of coupler 1450. Catches 1431 and 1432 may be configured to allow a first portion and a second portion respectively of signal cable 1410 to be constrained. Coupler 1450 may be held by the signal connectors 1421 and 1422 which may be wider than an opening in the catches 1431 and 1432. According to some of the various embodiments, a loop based attachment mechanism 1440 may be connected to coupler 1450 via, for example, loop 1442 passing through catches 1431 and 1432. The loop 1442 may be constructed using many materials including, but not limited to: wire, cloth, plastic, rubber, combinations thereof, and/or the like. A clip may hang from, be connected to, or be part of loop 1442.

Figure 15B:
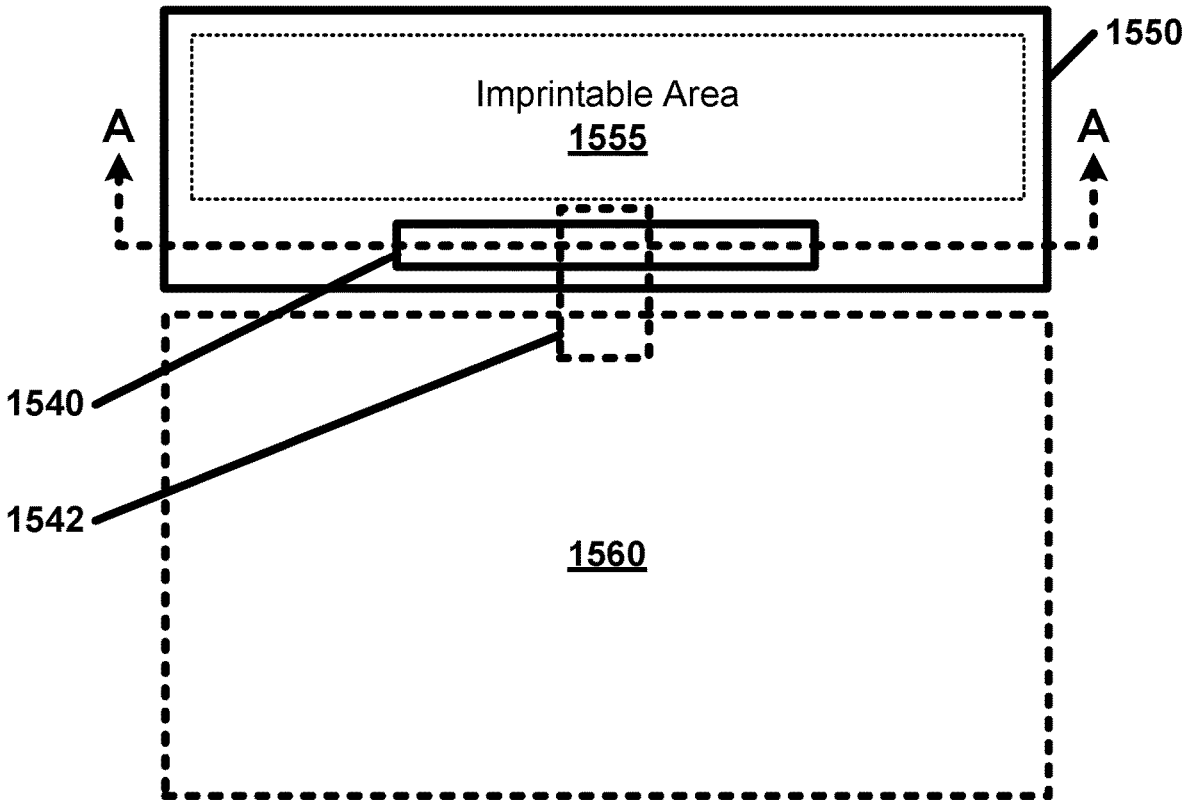
FIG. 15A and FIG. 15B are diagrams of a lanyard with an imprintable area as per an aspect of an embodiment of the present invention.
Figure 15A:
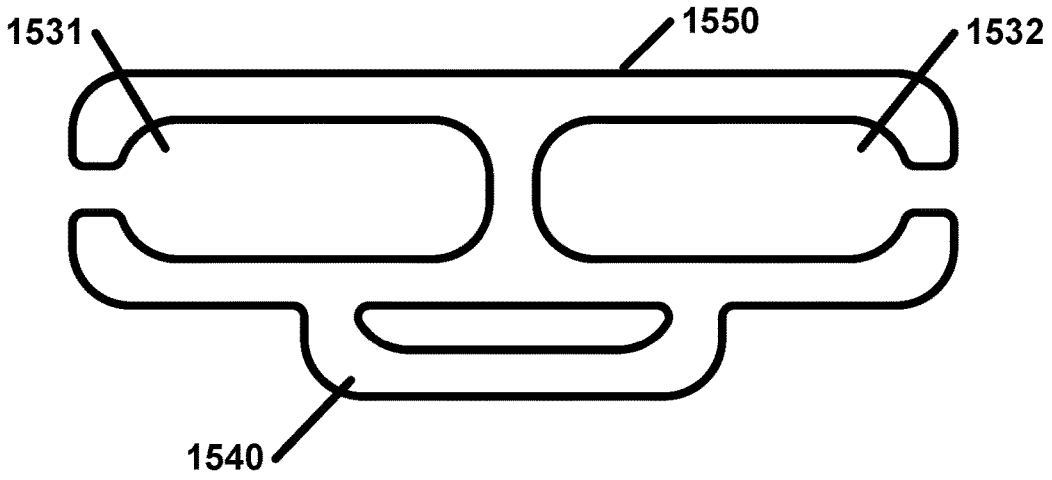

FIG. 15A and FIG. 15B are example diagrams of a lanyard coupler 1550 showing a front view (FIG. 15B) and top view along dashed line A-A (FIG. 15A) with catches 1531 and 1532 disposed with openings along the sides of coupler 1550. The coupler 1550 may have, as illustrated in this example, an imprintable area 1555. An attachment mechanism 1540 may comprise a hanger bar disposed along the lower front section of coupler 1550. As illustrated in this embodiment, coupler 1550, with catches 1531 and 1532 as well as attachment mechanism 1540 may be integrally formed. A tag 1560, such as for example, a name tag, may be attached to attachment mechanism 1540 via a clip 1542.

According to some of the various embodiments, a coupler may be formed by molding plastic, rubber, metal, composites, combinations thereof, and/or the like. Plastics are synthetically produced non-metallic compounds that may be molded into various forms and hardened for commercial use. Molten liquid plastic may be inserted into a shaped mold, for example, a mold of coupler 1550. The plastic may be allowed to cool. The mold may be removed to reveal the plastic coupler 1550. Some of the various techniques of plastic molding comprise, but are not limited to: injection molding, blow molding, compression molding, film insert molding, gas assist molding, rotational molding, structural foam molding, thermoforming, combinations thereof, and/or the like. In injection molding, melted plastic is forced into a mold cavity. Once cooled, the mold can be removed. Blow molding is similar to injection molding except that hot liquid plastic may pour out of a barrel vertically in a molten tube. The mold closes on the molten plastic and a force such as compressed gas moves the molten plastic outward to conform to the inside shape of the mold. When the plastic is cooled, the hollow part may be formed. In compression molding, a slug of hard plastic may be pressed between two heated mold halves. The parts formed may then be cooled (e.g. air-cooled). Film insert molding imbeds an image beneath the surface of a molded part. A material like film or fabric is inserted into a mold. Plastic may then be injected into the mold. Gas assist molding, also called gas injection molding may be employed to create plastic parts with hollow interiors where partial shot(s) of plastic may be followed by high-pressure gas to fill a mold cavity with plastic. Rotational molding employs hollow molds packed with powdered plastic secured to pipe-like spokes that extend from a central hub. The molds rotate on separate axes at once. The hub swings the whole mold to a closed furnace room causing the powder to melt and stick to the insides of the tools. As the molds turn slowly, the tools move into a cooling room. Here, sprayed water may be employed to cause the plastic to harden into a hollow part. Structural foam molding is a process of plastic molding usually used for parts that require thicker walls than standard injection molding. Inserting a small amount of nitrogen or chemical blow agent into the plastic material makes the walls thicker. Foaming happens as the melted plastic material enters the mold cavity. A thin plastic skin forms and solidifies in the mold wall. With thermoforming, sheets of pre-extruded rigid plastics may be heated and sucked down into a mold.

Figure 16A:
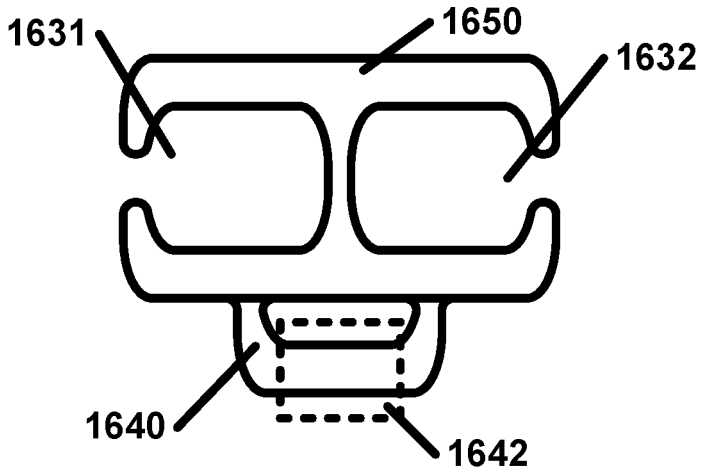
FIG. 16A, FIG. 16B and FIG. 16C are diagrams of a lanyard with an imprintable area and a hook attached to the attachment mechanism as per an aspect of an embodiment of the present invention.
Figure 16B:
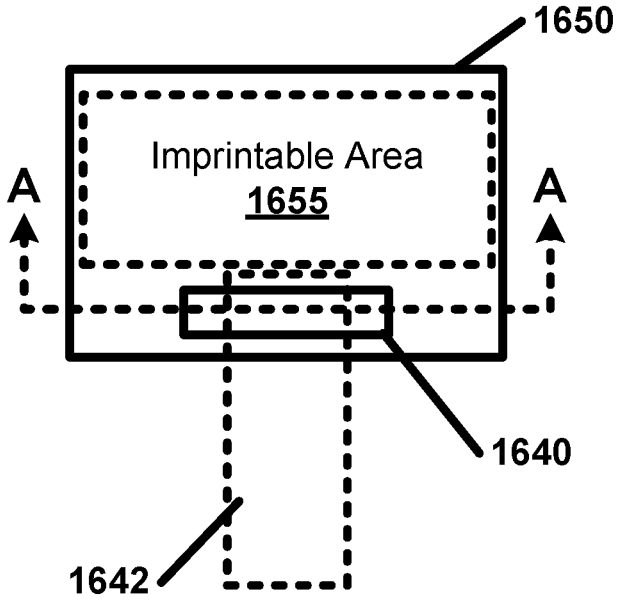
Figure 16C:
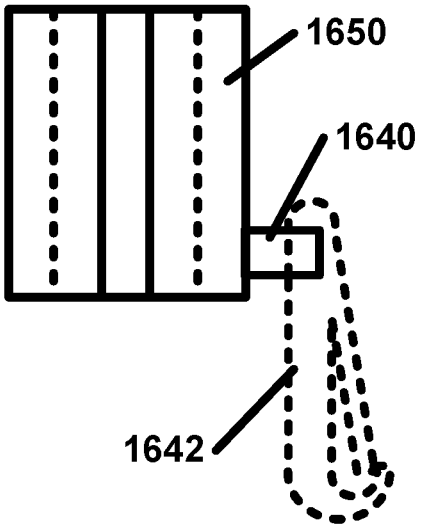

FIG. 16A, FIG. 16B and FIG. 16C are example diagrams of a lanyard coupler 1650 showing a front view (FIG. 16B), top view along dashed line A-A (FIG. 16A) and a side view (FIG. 16C) with catches 1631 and 1632 disposed with openings along the sides of coupler 1650. Coupler 1650 may be held by signal connectors which may be wider than an opening in the catches 1631 and 1632. According to some of the various embodiments, coupler 1650 may comprise an imprintable surface 1655 and a hook 1642 (or other type of hanger) attached to attachment mechanism 1640 as per an aspect of an embodiment of the present invention.

Figure 17B:
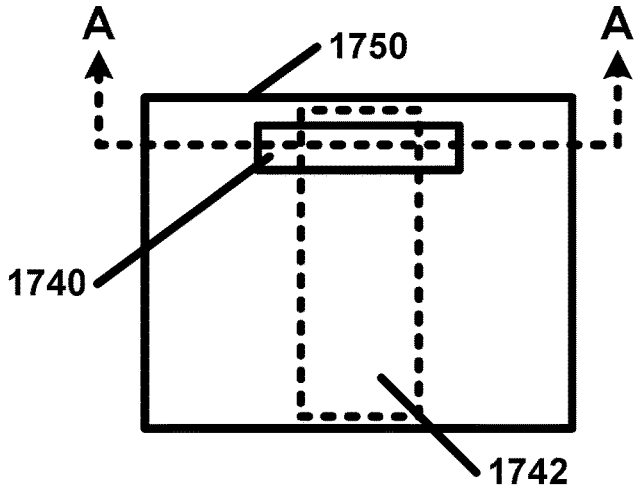
FIG. 17A, FIG. 17B and FIG. 17C are diagrams of a lanyard configured to hide the signal cable connectors as per an aspect of an embodiment of the present invention.
Figure 17A:
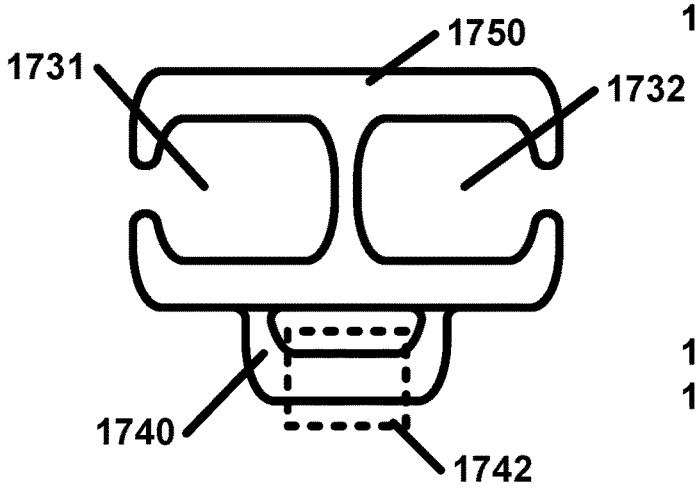
Figure 17C:
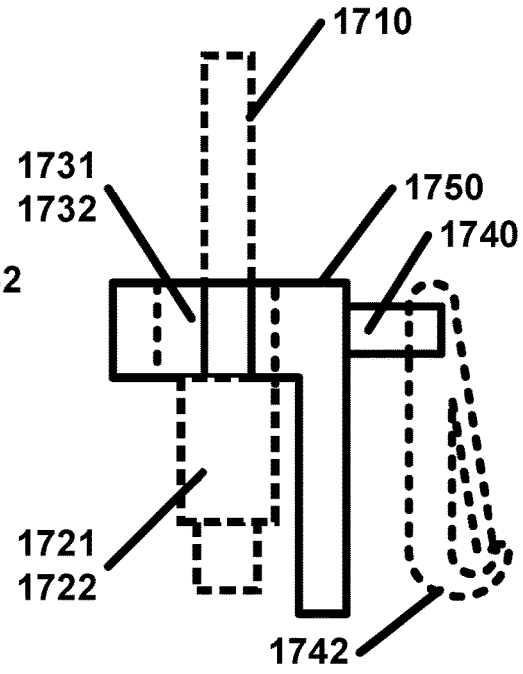

FIG. 17A, FIG. 17B and FIG. 17C are example diagrams of a lanyard coupler 1750 showing a front view (FIG. 17B), top view along dashed line A-A (FIG. 17A) and a side view (FIG. 17C) with catches 1731 and 1732 disposed with openings along the sides of coupler 1750. Coupler 1750 may be held by the signal connectors 1721 and 1722 at the end of signal cord 1710. Signal connectors 1721 and 1722 may be wider than an opening in the catches 1731 and 1732. According to some of the various embodiments, coupler 1750 may comprise an extended surface sized to hide signal couplers 1721 and 1722 from sight. Attachment mechanism 1740 may be disposed (separately or integrally) on coupler 1750. Attachment mechanism 1740 may be configured for a hook 1742 (or other type of hanger) to be mounted thereon.

Figure 18A:
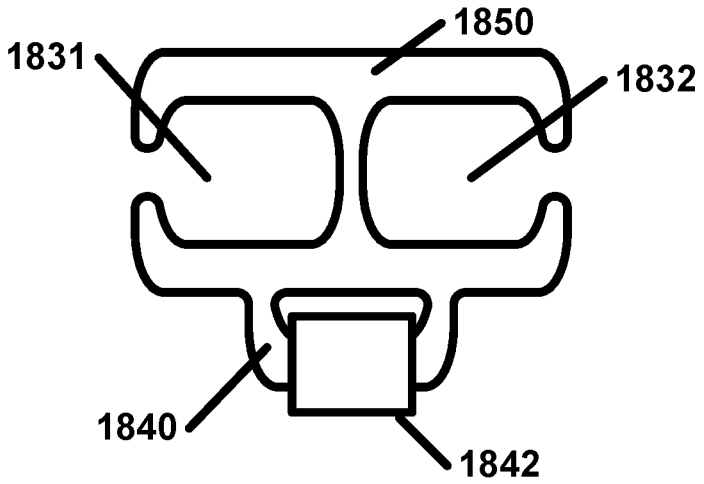
FIG. 18A, FIG. 18B and FIG. 18C are diagrams of a lanyard with an imprintable area and configured to hide the signal cable connectors as per an aspect of an embodiment of the present invention.
Figure 18B:
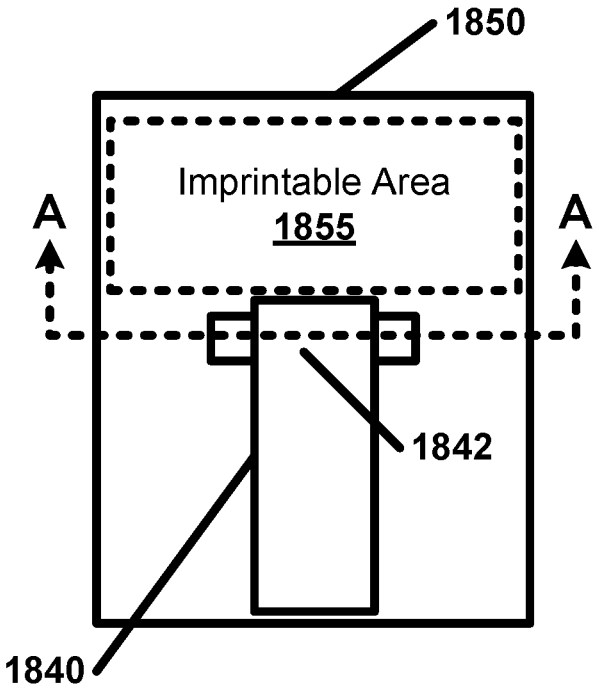
Figure 18C:
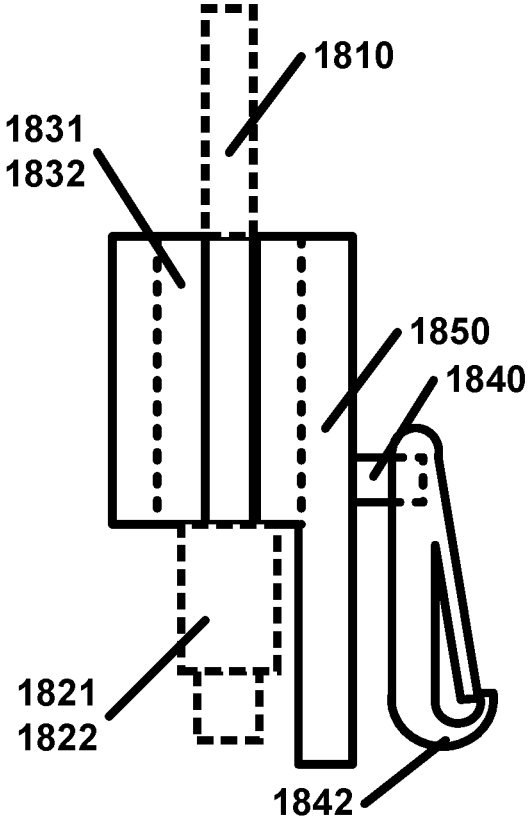

FIG. 18A, FIG. 18B and FIG. 18C are example diagrams of a lanyard coupler 1850 showing a front view (FIG. 18B), top view along dashed line A-A (FIG. 18A) and a side view (FIG. 18C) with catches 1831 and 1832 disposed with openings along the sides of coupler 1850. Coupler 1850 may be held by the signal connectors 1821 and 1822 at the end of signal cord 1810. Signal connectors 1821 and 1822 may be wider than an opening in the catches 1831 and 1832. According to some of the various embodiments, coupler 1850 may comprise an extended lower surface sized to hide signal couplers 1821 and 1822 from sight and an upper surface with an imprintable surface area 1855. Attachment mechanism 1840 may be disposed (separately or integrally) on coupler 1850. Attachment mechanism 1840 may be configured for a hook 1842 (or other type of hanger) to be mounted thereon.

Figure 19A:
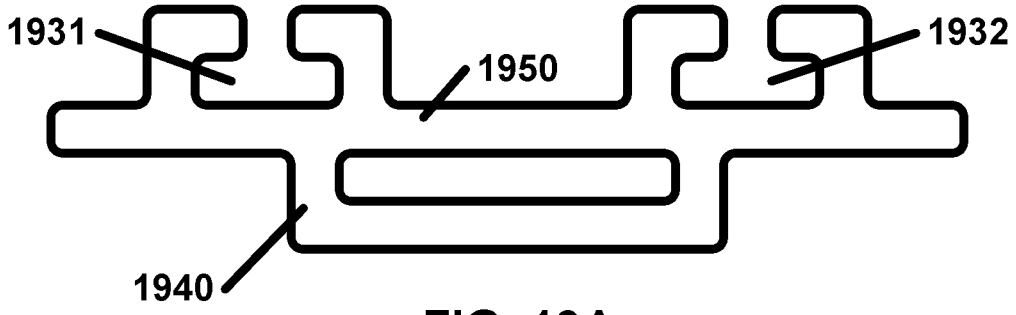
FIG. 19A, FIG. 19B and FIG. 19C are diagrams of a lanyard with an imprintable area and rear catches as per an aspect of an embodiment of the present invention.
Figure 19B:
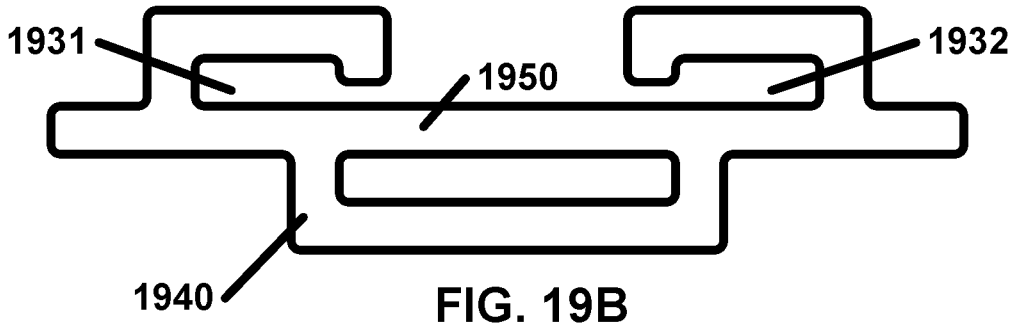
Figure 19C:
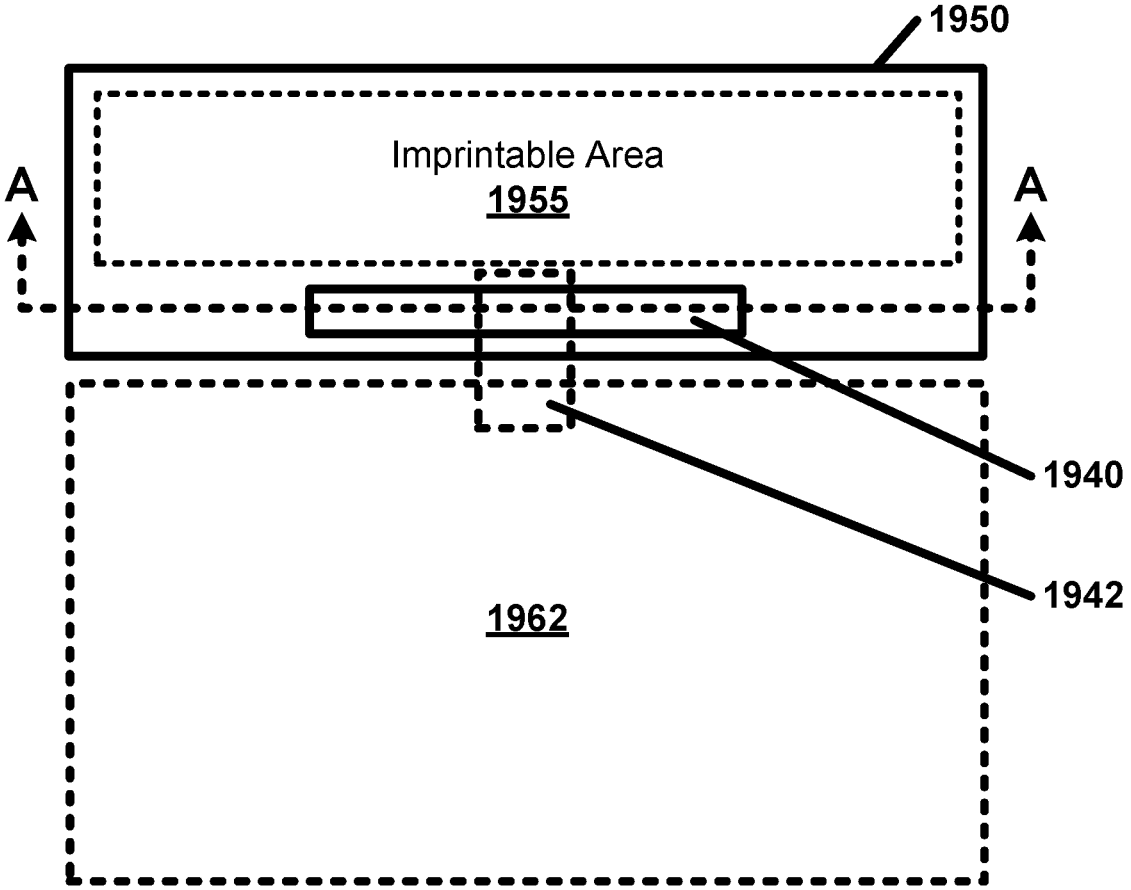

FIG. 19A, FIG. 19B and FIG. 19C are example diagrams of a lanyard coupler 1950 showing a front view (FIG. 19C), a first alternative embodiment top view along dashed line A-A (FIG. 19A) and a second alternative embodiment top view along dashed line A-A (FIG. 19B) with catches 1931 and 1932 disposed along the rear of coupler 1950. The coupler 1950 may have, as illustrated in this example, an imprintable area 1955. An attachment mechanism 1940 may comprise a hanger bar disposed along the lower front section of coupler 1950. As illustrated in this embodiment, coupler 1950, with catches 1931 and 1932 as well as attachment mechanism 1940 may be integrally formed. A tag 1962, such as for example, a name tag, may be attached to attachment mechanism 1940 via a clip 1942.

Figure 20A:
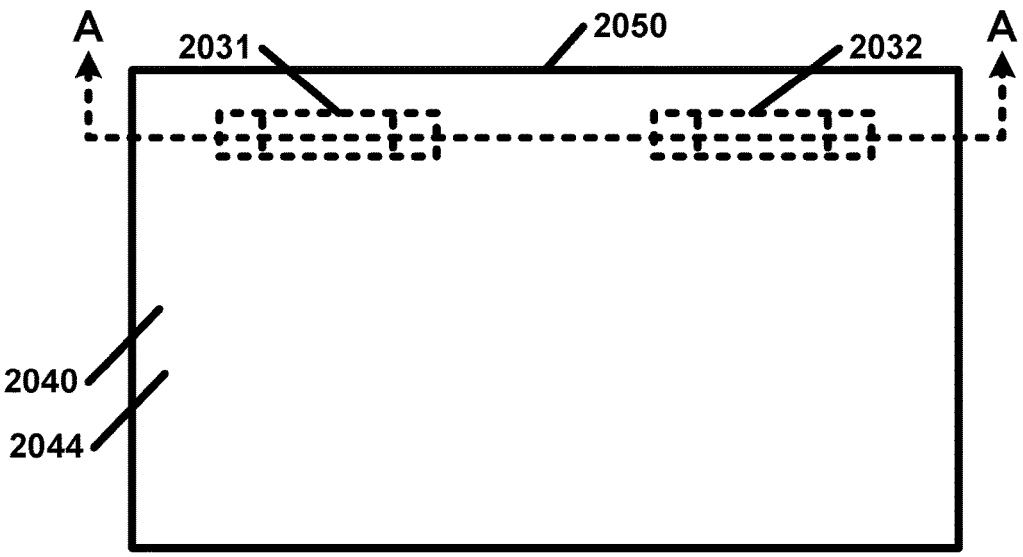
FIG. 20A, FIG. 20B, FIG. 20C and FIG. 20D are diagrams of a lanyard with rear catches and a front sleeve as per an aspect of an embodiment of the present invention.
Figure 20B:
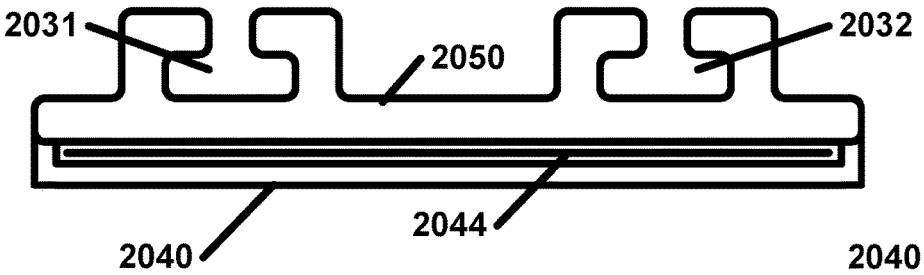
Figure 20C:
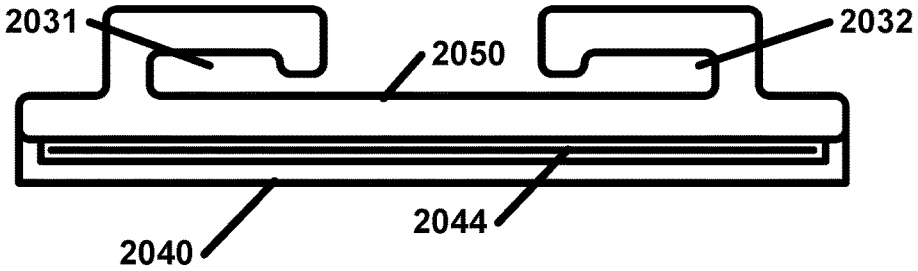
Figure 20D:
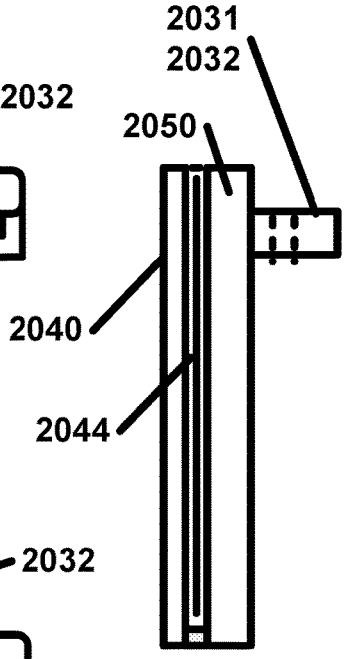

FIG. 20A, FIG. 20B, FIG. 20C and FIG. 20D are example diagrams of a lanyard coupler 2050 showing a front view (FIG. 20A), a first alternative embodiment top view along dashed line A-A (FIG. 20B), a second alternative embodiment top view along dashed line A-A (FIG. 20C), and a side view (FIG. 20D). The coupler 2050 may comprise catches 2031 and 2032 disposed along the rear of coupler 2050. An attachment mechanism 2040 may be disposed along the front of coupler 2050 to produce a pocket that can hold a card 2044. Example of card(s) 2044 include, but are not limited to: name tags, identification cards, access cards, combinations thereof, and/or the like. The attachment mechanism 2040 may be composed of a clear, transparent and/or semitransparent material such as, but not limited to: vinyl, acrylic (polymethlamethacrylate), butyrate (cellulose acetate butyrate), lexan (polycarbonate), PETG (glycol modified polyethylene terphthalate), and/or the like.

Figure 21A:
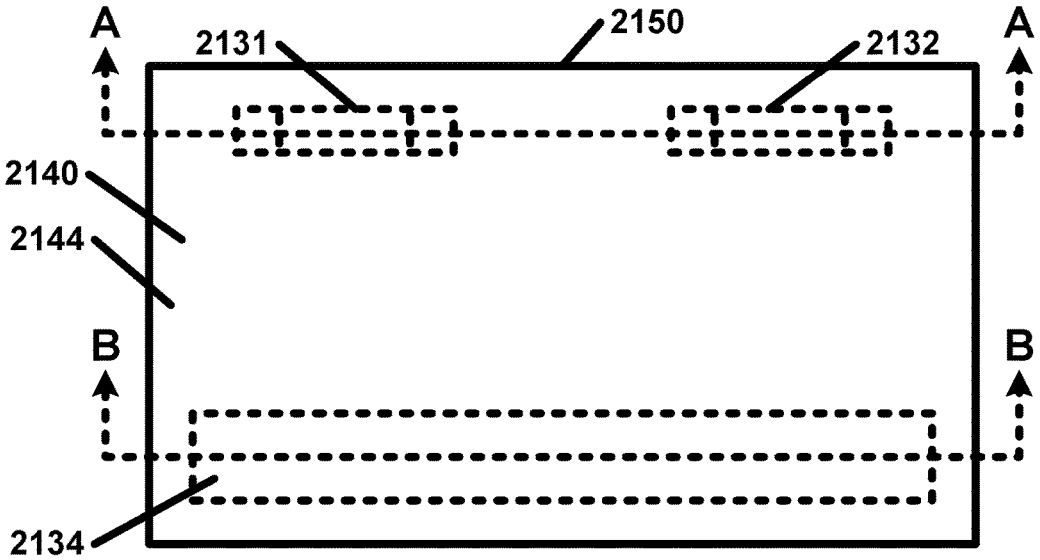
FIG. 21A, FIG. 21B, FIG. 21C and FIG. 21D are diagrams of a lanyard with upper and lower rear catches and a front sleeve as per an aspect of an embodiment of the present invention.
Figure 21B:
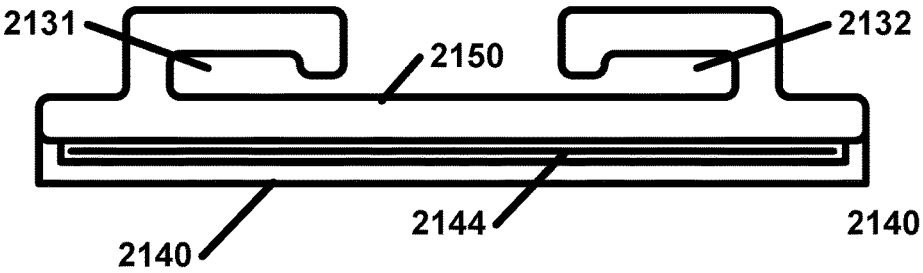
Figure 21C:
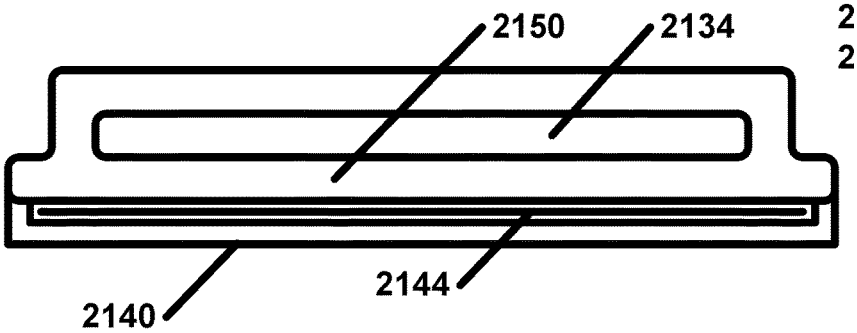
Figure 21D:
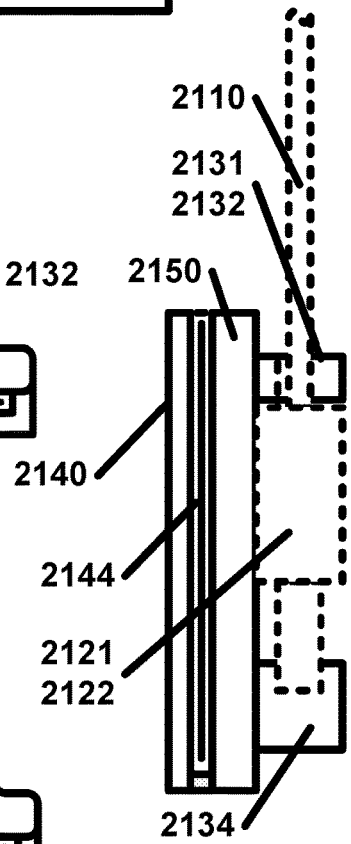

FIG. 21A, FIG. 21B, FIG. 21C and FIG. 21D are example diagrams of a lanyard coupler 2150 showing a front view (FIG. 21A), a first alternative embodiment top view along dashed line A-A (FIG. 21B), a second alternative embodiment top view along dashed line A-A (FIG. 21C), and a side view (FIG. 21D). The coupler 2150 may comprise catches 2131 and 2132 disposed along the upper rear of coupler 2150 and catch 2134 disposed along the lower rear of coupler 2150. Catches 2131 and 2132 may constrain the signal cable 2110. Coupler 2150 may be held upright by signal connectors 2121 and 2122 at the end of signal cord 2110. Signal connectors 2121 and 2122 may be wider than an opening in the catches 2131 and 2132. Catch 2134 may be configured to hold the connector end of signal connectors 2121 and/or 2122. Catch 2134 may be a single catch as illustrated or two catches, one for each of signal connectors 2121 and 2122. Attachment mechanism 2140 may be disposed along the front of coupler 2150 to produce a pocket that can hold a card 2144.

Figure 22A:
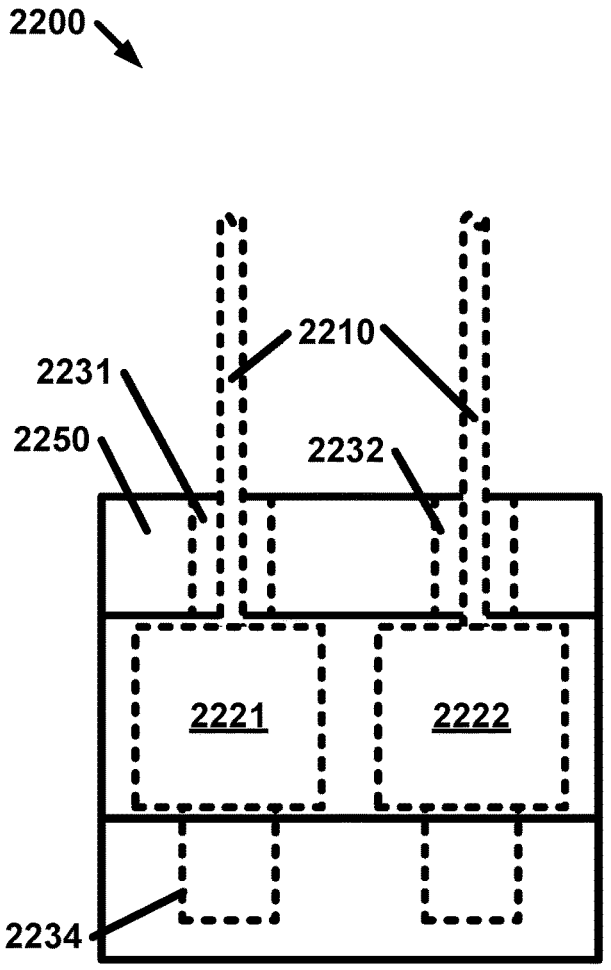
FIG. 22A and FIG. 22B are diagrams of a lanyard with rear upper embedded catches, a lower connector pocket and a front sleeve as per an aspect of an embodiment of the present invention.
Figure 22B:
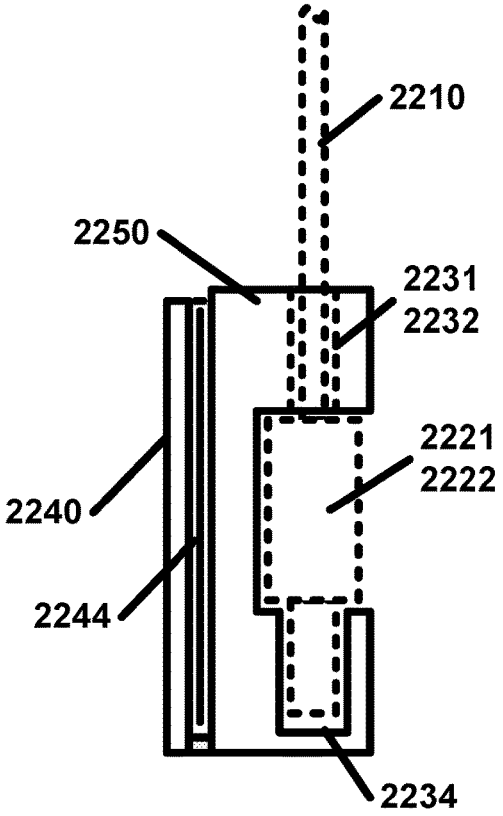

FIG. 22A and FIG. 22B are example diagrams of a lanyard 2200 coupler 2250 showing a front view (FIG. 22A) and a side view (FIG. 22B). The coupler 2250 may comprise catches 2231 and 2232 disposed along the upper rear of coupler 2250 and catch 2234 disposed along the lower rear of coupler 2250. Catches 2231 and 2232 may constrain the signal cable 2210. Coupler 2250 may be held upright by signal connectors 2221 and 2222 at the end of signal cord 2210. Signal connectors 2221 and 2222 may be wider than an opening in the catches 2231 and 2232. Catch 2234 may be configured to hold the connector end of signal connectors 2221 and/or 2222. Catch 2234 may be a single catch as illustrated or two catches, one for each of signal connectors 2221 and 2222. Attachment mechanism 2240 may be disposed along the front of coupler 2250 to produce a pocket that can hold a card 2244.

Figure 23A:
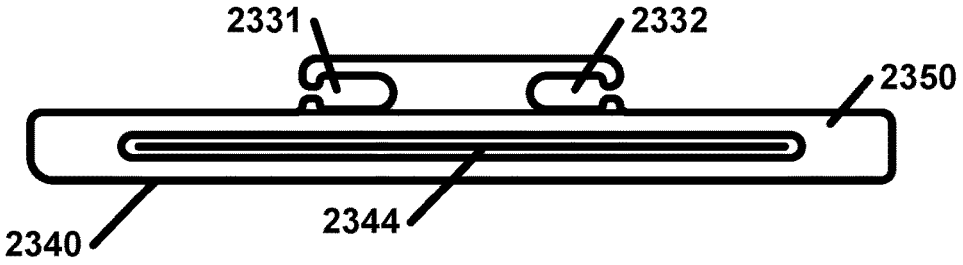
Figure 23B:
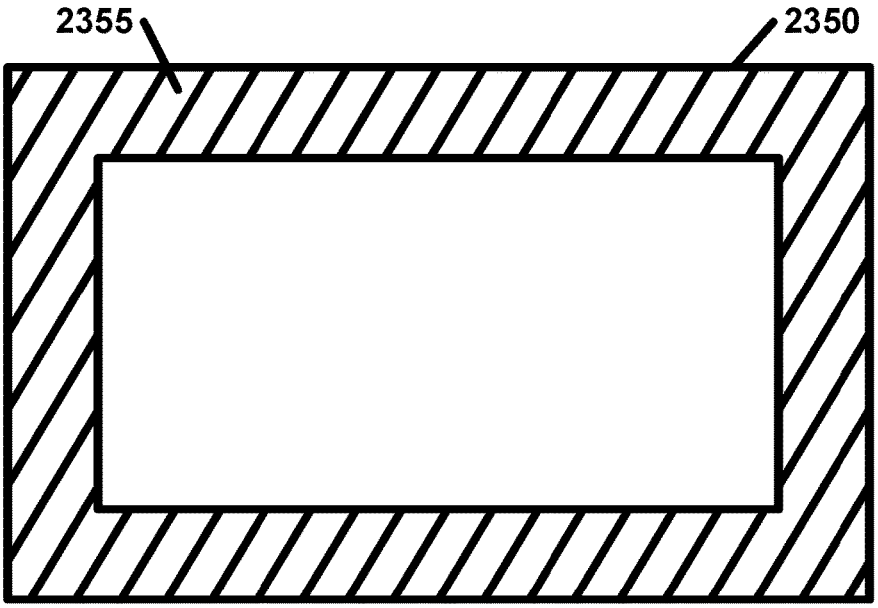
Figure 23C:
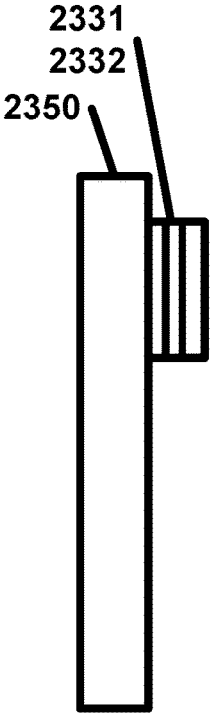
Figure 24A:
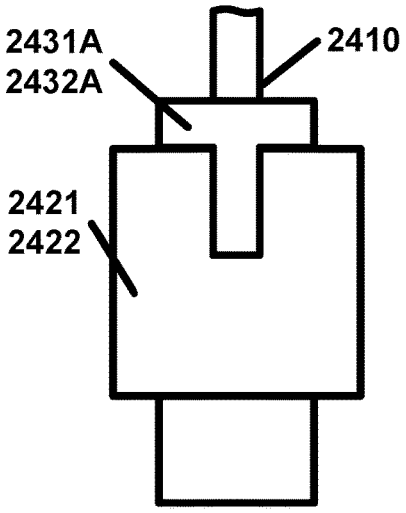
FIG. 24A, FIG. 24B, FIG. 24C and FIG. 24D are diagrams of a lanyard coupler with catches as per an aspect of an embodiment of the present invention.
Figure 24B:
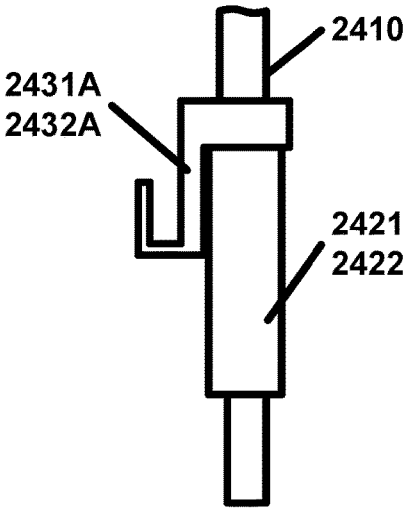
Figure 24C:
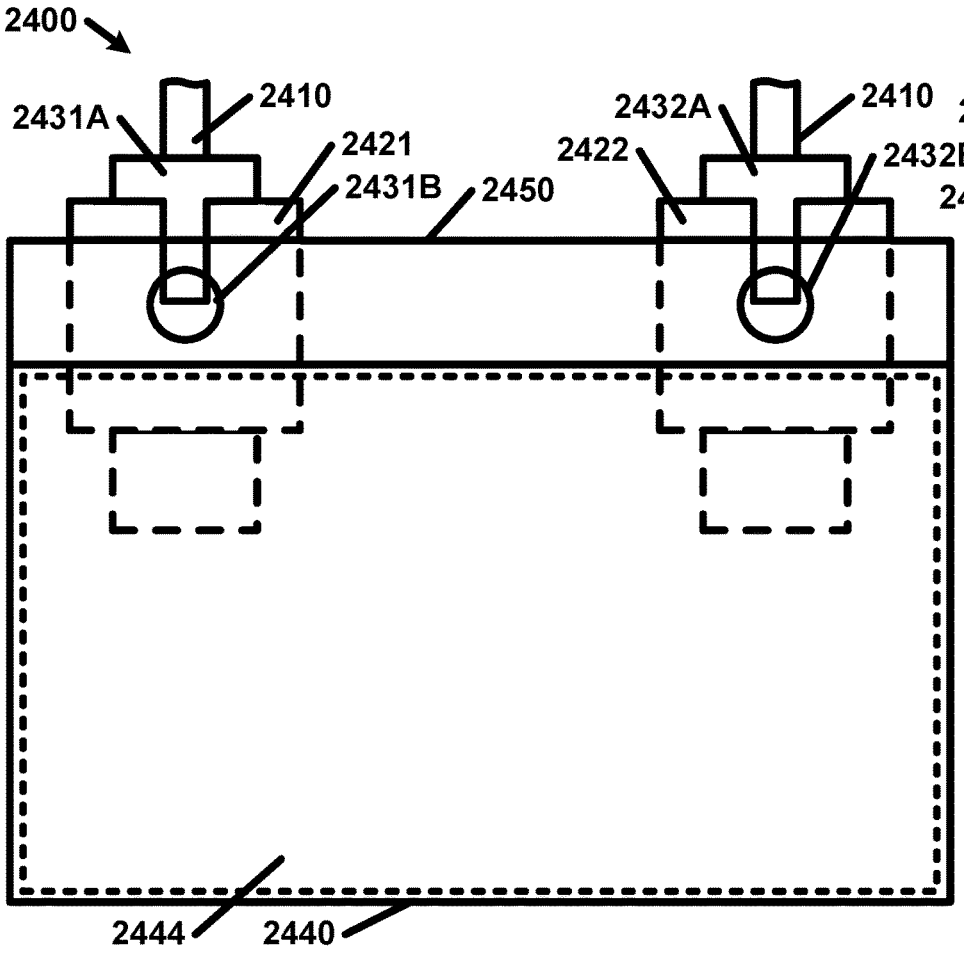
Figure 24D:
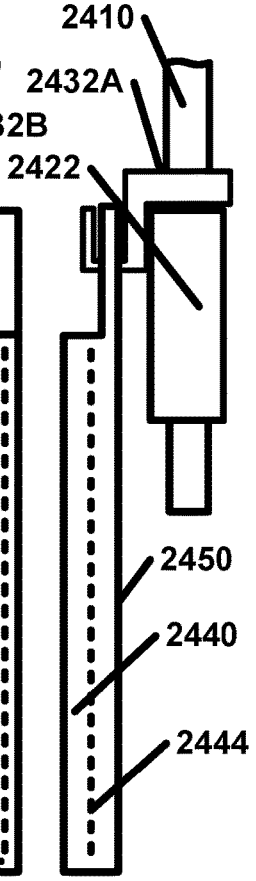

FIG. 23A, FIG. 23B and FIG. 23C are example diagrams of a lanyard coupler 2350 with rear embedded catches showing a front view (FIG. 23B), a top view (FIG. 23A), and a side view (FIG. 23C). This example embodiment illustrates one of the various alternative locations for imprintable surface(s)/area(s) 2355. The coupler 2350 may comprise catches 2331 and 2332 disposed along the rear of coupler 2350. An attachment mechanism 2340 may be disposed along the front of coupler 2350 to produce a pocket that can hold a card 2344. Example of card(s) 2344 include, but are not limited to: name tags, identification cards, access cards, combinations thereof, and/or the like. In this example illustration, an imprintable surface(s)/area(s) 2355 surrounds a sleeve opening that exposes the card 2344. The sleeve opening may be covered with another material such as a clear plastic, an imprintable material, and/or the like. It is envisioned that imprintable surface(s)/area(s) may be formed on many alternative locations of the coupler 2355. Alternatively, other parts of the lanyard may comprise an imprintable area. Coupler 2350 may be shaped into patterns such as, but not limited to: animal shapes, object shapes, logo shapes, text shapes, combinations thereof, and/or the like.

FIG. 24A, FIG. 24B, FIG. 24C and FIG. 24D are example diagrams of a lanyard coupler 2450 with catches (2431A, 2431B, 2432A, and 2432B) showing a front view of signal connector 2421/2422 (FIG. 20A), a side view of signal connector 2421/2422 (FIG. 20B), a front view of lanyard 2400 (FIG. 20C), and a side view of lanyard 2400 (FIG. 20D). This example embodiment illustrates one of the various alternative locations for the catches (2431A, 2431B, 2432A, and 2432B). In this example embodiment, the catches comprise a first hook 2431A and 2432A disposed upon signal connector 2421 and 2422 respectively at the ends of signal cable 2410. The first hook 2431A and 2432A may be configured to hold coupler 2450 via catch openings 2431B and 2432B respectively. An attachment mechanism 2440 may be disposed along the front of coupler 2450 to produce a pocket that can hold a card 2444.

At least one embodiment may comprise: a signal cable, a first fastener, a second fastener, and a third fastener. The signal cable may comprise: a first end, a second end and a center portion. A first portion may reside between the center portion and the first end. A second portion may reside between the center portion and the second end. A first signal connector may be disposed at the first end of the signal cable. A second signal connector may be disposed at the second end of the signal cable. The first fastener may be configured to constrain the first portion. The second fastener may be configured to constrain the second portion. The third fastener may be configured to: hold an independent article; and connect with the first fastener and the second fastener.

In this specification, "a" and "an" and similar phrases are to be interpreted as "at least one" and "one or more."

References to "an" embodiment in this disclosure are not necessarily to the same embodiment.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purposes required by law, but otherwise reserves all copyright rights whatsoever.

While various embodiments have been described above, it should be understood that they have been presented by way of example, and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above described exemplary embodiments. In particular, it should be noted that, for example purposes, the above explanation has focused on the example(s) of name tags. However, one skilled in the art will recognize that embodiments of the invention could be applied to other types of lanyards, such as lanyards that are configured to hold, keys, whistles, and/or the like. Yet other types of usage of the present embodiments may be employed to hang signs, devices, and/or the like.

In addition, it should be understood that any figures that highlight any functionality and/or advantages, are presented for example purposes only. The disclosed architecture is sufficiently flexible and configurable, such that it may be utilized in ways other than that shown. Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

The invention claimed is:

1. A lanyard comprising:
(a) a signal cable comprising:
(i) a first signal connector at a first end of the signal cable; and
(ii) a second signal connector at a second end of the signal cable; and
(b) a coupler configured to be supported by the first signal connector and the second signal connector, the coupler comprising:
(i) a first fastener configured to constrain the first signal connector;
(ii) a second fastener configured to constrain the second signal connector; and
(iii) a third fastener configured to hold an article;
(c) wherein the signal cable terminates at the first signal connector and the second signal connector.

2. The lanyard according to claim 1, wherein the coupler is connected to the first signal connector.

3. The lanyard according to claim 2, wherein the coupler is connected to the second signal connector.

4. The lanyard according to claim 1, wherein the first fastener and second fastener are configured to slide along the signal cable and are not detachable from the signal cable.

5. The lanyard according to claim 1, wherein the coupler further comprises a battery.

6. The lanyard according to claim 1, wherein the coupler further comprises at least one pocket configured to hold the signal end of at least the first signal connector and the second signal connector.

7. A lanyard sized to hang around a portion of a human being, the lanyard comprising:
(a) a signal cable structured to carry electronic signals;
(b) two signal connectors, one at each end of the signal cable, each of the two signal connectors comprising:
(i) an end portion removably connectable to an electronic device and structured to transmit electronic signals between the signal cable and the electronic device; and
(ii) a non-metallic material partially surrounding the end portion; and
(c) a coupler:
(i) structured to hold together the two signal connectors; and
(ii) comprising an attachment mechanism positioned to support a suspended physical article;
(d) wherein the signal cable terminates at the signal connectors.

8. The lanyard of claim 7, wherein:
(a) for a first of the two signal connectors, the non-metallic material comprises a male member; and
(b) for a second of the two signal connectors, the non-metallic material comprises a female member structured to fit with the male member.

9. The lanyard of claim 8, wherein the female member is a recess and the male member is a protrusion sized to fit in the recess.

10. The lanyard of claim 9, wherein the male member slidably fits in the recess.

11. The lanyard of claim 9, wherein the male and the female members constrain motion of the two signal connectors to only one of three orthogonal axes.

12. The lanyard of claim 7, wherein the coupler forms a shape within which the two signal connectors can fit.

13. The lanyard of claim 12, wherein the coupler:
(a) is sized to contain part of the non-metallic material of each of the two signal connectors and the end portions of each of the two signal connectors; and
(b) connects to an end part of each of the two signal connectors.

14. The lanyard of claim 13, wherein, for each of the two signal connectors, the end part to which the coupler connects is a part of the non-metallic material.

15. The lanyard of claim 14, wherein:
(a) for each of the two signal connectors, the non-metallic material has a narrower portion and a wider portion; and
(b) the end part to which the coupler connects is the narrower portion and not the wider portion.

16. The lanyard of claim 7, wherein the coupler is integrally connected to the non-metallic material of a first of the two signal connectors and removably connected to a second of the two signal connectors.

17. The lanyard of claim 16, wherein the second of the two signal connectors and the coupler are structured to snap together.

18. The lanyard of claim 7, wherein the electronic signals are power signals.

19. The lanyard of claim 7, wherein:
(a) the electronic signals are data signals; and
(b) the end portions of the respective signal connectors are interfaces that use a common data protocol.

20. The lanyard of claim 7, wherein the attachment mechanism comprises a hole or a slot through the coupler.

21. The lanyard of claim 20, wherein the attachment mechanism further comprise a loop, clip, buckle, or ring fitted through the hole or slot.

22. The lanyard of claim 7, further comprising the physical article suspended from the attachment mechanism, and wherein the physical article is a card or card holder.

23. The lanyard according to claim 7, wherein the coupler further comprises at least one pocket configured to hold the end portion of at least the first signal connector and the second signal connector.

* * * * *